US006634401B2

(12) United States Patent
Kuhn et al.

(10) Patent No.: US 6,634,401 B2
(45) Date of Patent: Oct. 21, 2003

(54) TAPE APPLICATOR AND METHODS OF APPLYING TAPE TO A SURFACE

(75) Inventors: Gary K. Kuhn, Stillwater, MN (US); Michael G. Slagter, Lakeland, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 25 days.

(21) Appl. No.: 09/966,138

(22) Filed: Sep. 27, 2001

(65) Prior Publication Data

US 2003/0056905 A1 Mar. 27, 2003

(51) Int. Cl.[7] ..... B32B 31/18; B32B 31/20; B32B 35/00

(52) U.S. Cl. ..... 156/510; 156/538; 156/584

(58) Field of Search ..... 156/391, 443, 156/459, 510, 572, 517, 537, 538, 539, 540, 584

(56) References Cited

U.S. PATENT DOCUMENTS

| | | | | |
|---|---|---|---|---|
| 4,285,752 A | * | 8/1981 | Higgins | 156/250 |
| 4,294,644 A | | 10/1981 | Anderson | |
| 4,813,571 A | | 3/1989 | Slagter | |
| 4,961,816 A | | 10/1990 | Lisec | |
| 4,978,417 A | | 12/1990 | Grimshaw et al. | |
| 4,981,545 A | | 1/1991 | Shinno et al. | |
| 5,011,563 A | | 4/1991 | Shinno et al. | |
| 5,072,359 A | | 12/1991 | Kneifel, II | |
| 5,346,350 A | | 9/1994 | Luhman et al. | |
| 5,356,505 A | | 10/1994 | Salvatore | |
| 5,370,754 A | | 12/1994 | Soloman | |
| 5,441,846 A | | 8/1995 | Nagate et al. | |
| 5,458,726 A | | 10/1995 | Castoldi | |
| 5,482,593 A | | 1/1996 | Kuhn et al. | |
| 5,536,044 A | | 7/1996 | Luhman et al. | |
| 5,714,028 A | * | 2/1998 | Horai et al. | 156/212 |
| 5,840,407 A | | 11/1998 | Futhey et al. | |
| 6,030,475 A | | 2/2000 | Spotts, Jr. | |
| 6,066,218 A | | 5/2000 | Kuhn et al. | |
| 6,180,196 B1 | | 1/2001 | Glover et al. | |

FOREIGN PATENT DOCUMENTS

| | | |
|---|---|---|
| DE | 43 04 825 A1 | 8/1994 |
| EP | 0 286 343 | 10/1988 |
| EP | 0 911 263 | 4/1999 |
| JP | 07-101618 | 4/1995 |
| JP | 9-138647 | 5/1997 |
| JP | 11-334981 | 12/1999 |
| JP | 2000-313562 | 11/2000 |

OTHER PUBLICATIONS

U.S. patent application Ser. No. 09/759,795, filed Jan. 12, 2001, A Tape Applicator and Methods Of Applying Tape To A Surface.

Brochure by 3M, "Accentrim™ Products," 1999.

Operating Instructions, 3M M45 Precision Cutter, Type 19900, 1999.

* cited by examiner

*Primary Examiner*—Richard Crispino
*Assistant Examiner*—Sing B Chan
(74) *Attorney, Agent, or Firm*—Melissa F. Buss

(57) ABSTRACT

A tape applicator. A preferred embodiment of the invention provides a tape applicator having a tape head, a x-axis actuator for moving the tape head in the x-axis direction, and a y-axis actuator for moving the tape head in the y-axis direction. The tape head preferably includes: i) a base; ii) a tape roll holder attached to the base; iii) a tape application roller attached to the base for applying the tape to a surface; iv) a cutter attached to the base for cutting tape to form a removeable portion of a tape; and v) a remover attached to the base for removing the removeable portion of the tape. The present invention also relates to methods of applying tape to a surface.

17 Claims, 15 Drawing Sheets

TAPE APPLICATOR AND METHODS OF APPLYING TAPE TO A SURFACE

TECHNICAL FIELD

The present invention relates to a tape applicator including a tape head. The present invention relates more particularly to a tape applicator including a tape head comprising: a base; ii) a tape roll holder attached to the base; iii) a tape application roller attached to the base for applying the tape to a surface, where the tape head includes a tape path from the tape roll holder to the tape application roller; iv) a cutter attached to the base along the tape path between the tape roll holder and the tape applicator roller for cutting tape to form a removeable portion of a tape; and v) a remover attached to the base along the tape path between the cutter and the tape application roller for removing the removeable portion of the tape. The present invention also relates to methods of applying tape to a surface.

BACKGROUND OF THE INVENTION

Various apparatuses and methods for attaching tape or labels to articles are known in the art. For example, U.S. Pat. No. 5,356,505 to Salvator discloses an applicator for evenly applying an adhesive backed foil to edges of pieces of stained glass. The applicator includes guide members, which direct a foil strip from a foil spool past an application point to a take-up reel. The take-up reel is motor driven to pull the foil from the foil spool at a constant speed and to wind up a protective backing after the backing has been removed from the foil and the foil applied to the edge of a piece of stained glass.

U.S. Pat. No. 6,030,475 to Spotts, Jr. discloses a sealant strip applying system for applying a sealant strip to a top surface of a sheet material adjacent to a plurality of straight edges. The system is configured to support the sheet material and to produce the controlled repositioning thereof on an air flotation table with each edge being selectively aligned with a front edge of the table. The sealant strip is successively applied to each edge by a sealant strip applicator that is supported by the air flotation table and mounted for selective movement along the front edge thereof.

U.S. Pat. No. 5,441,846 to Negate et al. discloses a system for the preparation of a light-sensitive material comprising a substrate, a light-sensitive layer and a base film which comprises a roller for providing a continuous light-sensitive sheet comprising the base film, the light-sensitive layer and a protective film; means for cutting the light-sensitive layer and a protective layer in the traverse direction; fixing means for temporarily fixing the sheet; a roller for providing an adhesive tape for removing the protective film; the adhesive tape-collecting roller; a bar for pressing the adhesive tape by its tip to the front end of the light-sensitive sheet and to press the front end against the bottom of the fixing means and peeling the protective film from the sheet; a dancer roll; light-sensitive sheet cutting means; substrate supplying means; and heat rollers for laminating the base film and light-sensitive layer on the substrate.

U.S. Pat. No. 4,294,644 to Anderson discloses a servomotor control labeler. The servo motor drives the label feed and employs a control system for the servomotor, which is responsive to the rate of feed or speed of the surface to be labeled as it is advanced to the labeler. The control system on receiving an instruct-to-label signal accelerates the servo motor smoothly from zero to the desired labeling speed while the surface to be labeled is advanced toward the labeler a predetermined distance and on receiving an end to labeling signal decelerates the servo motor smoothly from labeling speed to zero while the label feed is advanced a predetermined distance. The arrangement is such that upon an instruct to label signal being fed to the control system at a predetermined position of advance of the surface relative to the labeler the labeler will accelerate a label from a predetermined start position and deliver same to touch down on the surface to be labeled at the precise desired point with the label moving at the same speed as the surface and upon an end to labeling signal generated by a label feed sensor being fed to the control system the labeler will decelerate to bring the next label to be delivered to the predetermined start position in preparation for the next instructing-to-label signal.

Various types of tape are known. For example, U.S. Pat. No. 5,840,407 to Futhey et al. discloses a tape having transparent optical film made of a polymeric material that has a first smooth surface and a second structured surface for providing a simulated beveled appearance. The structured surface of the film is formed of a plurality of spaced parallel grooves, each groove being formed by a first facet which is substantially perpendicular to the first smooth surface and a second facet which makes an angle between 1 to 60 degrees with the first smooth surface. The film may be affixed to glass, the adhesive applied to the first smooth surface or the second structured surface, to simulate beveled glass. Another example of a tape is commercially available as 3M™ Accentrim™ Tape, series B200 and series B100, from 3M Company, located in St. Paul, Minn.

SUMMARY OF THE INVENTION

One aspect of the present invention provides a tape head. The tape head, comprises:i) a base; ii) a tape roll holder attached to the base; iii) a tape application roller attached to the base for applying the tape to a surface, where the tape head includes a tape path from the tape roll holder to the tape application roller; iv) a cutter attached to the base along the tape path between the tape roll holder and the tape applicator roller for cutting tape to form a removeable portion of a tape; and v) a remover attached to the base along the tape path between the cutter and the tape application roller for removing the removeable portion of the tape. In one preferred embodiment of the above tape head, the cutter comprises a rotary die. In one aspect of this embodiment, the rotary die is configured to cut one of a plurality of shapes.

In another preferred embodiment of the above tape head, the tape head further comprises a first actuator for moving the remover from a first position adjacent the tape path to a second position remote the tape path. In one aspect of this embodiment, the remover includes a pad, where the pad includes an exposed face facing the tape path, where the pad is configured to contact the removable portion of the tape. In another aspect of this embodiment, the pad moves to a first position adjacent the removeable portion of the tape to a second position remote the tape path, the first position of the pad adjusts to accommodate the accumulated thickness of the increasing number of removed portions of tape. In another aspect of this embodiment, the remover further includes a channel, where the pad is slideably engaged with the channel, where as the pad accumulates increasing number of the removable portions of the tape, the pad moves to successive first positions within the channel to accommodate the accumulated thickness of the increasing number of removed portions of tape. In yet another aspect of this embodiment, the pad further includes an adhesive layer on the exposed face of the pad, where when the pad is in the first position, the adhesive layer adheres to a first removeable portion of tape. In another aspect of this embodiment, the tape includes a tape backing and a layer of adhesive on the backing, where the tape is on a liner, where after the remover moves to the second position, the remover moves to the first position and the layer of adhesive on the first removeable portion of tape adheres to a second removeable portion of tape. In another preferred embodiment of the above tape head, the tape head further comprises a second actuator for moving the tape application roller from a first position remote the tape path to a second position adjacent the tape path.

In another preferred embodiment of the above tape head, the tape head further comprises a unwind roller attached to the base along the tape path between the tape roll holder and the tape application roller. In one aspect of this embodiment, the tape head further comprises a motor for driving the unwind roller at a speed greater than or equal to the speed the tape head is applying tape to a surface. In yet another preferred embodiment of the above tape head, the tape head further comprises a platen attached to the base along the tape path between the remover and the tape application roller, where the platen includes an edge, where the tape head further comprises a liner roller attached to the base, where the tape head includes a liner tape path from the edge to the liner roller. In another aspect of this embodiment, the liner roller is a driven liner roller.

Another aspect of the present invention provides a tape applicator including the tape head described above, where the tape applicator further comprises: an x-axis actuator operatively connected to the tape head for moving the tape head in the x-axis direction; and a y-axis actuator operatively connected to the tape head for moving the tape head in the y-axis direction. In one aspect of this embodiment, the tape applicator further comprises: a rotary actuator operatively connected to the tape head for rotating the tape head around the z-axis direction.

Another aspect of the present invention provides a tape applicator including the tape head describe above, where the tape applicator further comprises: a frame having a tabletop, where the tabletop includes an x-axis and a y-axis; a first sliding rod attached to the tabletop, where the first sliding rod extends in the x-axis direction; and a support arm for the tape head, where the support arm is moveably engaged to the first sliding rod, where the support arm extends in the y-axis direction, where the support arm includes second sliding rod extending in the y-axis direction, where the tape head is moveably engaged to the second sliding rod. In one aspect of this embodiment, the tape applicator further comprises: an x-axis actuator operatively connected to the tape head for moving the support arm in the x-axis direction along the first sliding rod; a y-axis actuator operatively connected to the tape head for moving the tape head in the y-axis direction along the second sliding rod; a rotary actuator operatively connected to the tape head for rotating the tape head around the z-axis direction; and a z-axis actuator operatively connected to the tape head for moving the tape head in the z-axis direction along a third sliding rod, where the third sliding rod is attached to the support arm, and where the third sliding rod extends in the z-axis direction.

Another aspect of the present invention provides a method of applying a tape to a surface. This method of applying a tape to a surface comprises the steps of: a) providing a tape, where the tape includes a tape backing and an adhesive on the tape backing, and where the tape is on a liner; b) cutting the tape to provide a first length of tape, a second length of tape, and a removable portion of the tape located between the first length of tape and the second length of tape; c) removing the removable portion of the tape from the liner; d) separating the first length of tape from the liner; and e) applying the first length of tape to a surface.

In one preferred embodiment of the above method, the method further comprises: f) separating the second length of tape from the liner; and g) applying the second length of tape to the surface. In one aspect of this embodiment, the removable portion includes a first end and a second end opposite the first end, and where step b) includes cutting a portion of the first end of the removable portion at an angle oblique to the length of the tape. In another aspect of this embodiment, step b) includes cutting the first end of the removable portion to include a first side and a second side, where the first side and second side form an included angle less than 180°. In yet another aspect of this embodiment, step b) further includes cutting a portion of the second end of the removable portion at an angle oblique to the length of the tape. In another aspect of this embodiment, step b) includes cutting the first end of the removable portion to include a first side and a second side, where the first side and second side form an included angle less than 180°.

In another preferred embodiment of the above method, the tape is a decorative tape. In yet another preferred embodiment of the above method, the tape is applied to a glass surface, and where the tape provides a simulated beveled appearance.

Another aspect of the present invention provides a method of applying a tape to a surface. This method of applying a tape to a surface comprises the steps of: a) providing a tape; b) cutting the tape to form a first removable portion of the tape and a first length of tape; c) removing the first removable portion of the tape; d) applying the first length of tape to a surface; e) cutting the tape to form a second removable portion of the tape and a second length of tape; f) removing the second removable portion of the tape; g) stacking the second removable portion of the tape on the first removable portion of the tape; and h) applying the second length of tape to the surface. In one aspect of this embodiment, the tape includes a tape backing, an adhesive on the tape backing, and a liner on the adhesive, where steps b) and e) include cutting the first removable portion of the tape through the backing and the adhesive, and where step g) includes adhering the tape backing of the second removable portion of the tape to the adhesive of the first removable portion of the tape. In another aspect of this embodiment, the method further comprises the steps of: i) advancing the tape forward; and j) repeating steps b) and h).

In another preferred embodiment of the above method, the first removable portion includes a first end and a second end opposite the first end, and where step b) includes cutting a portion of the first end of the first removable portion at an angle oblique to the length of the tape. In another aspect of this embodiment, step b) includes cutting the first end of the first removable portion to include a first side and a second side, where the first side and second side form an included angle less than 180°. In another aspect of this embodiment, step b) further includes cutting a portion of the second end of the first removable portion at an angle oblique to the length of the tape. In yet another aspect of this embodiment, step b) includes cutting the first end of the first removable portion to include a first side and a second side, where the first side and second side form an included angle less than 180°. In another aspect of this embodiment, the second removable portion includes a first end and a second end opposite the first end, where step e) includes cutting the first end of the removable portion to include a first side and a second side and cutting the second end of the first removable portion to include a first side and a second side, where the first side and second side of the first end form an included angle less than 180°, and where the first side and second side of the second end form an included angle less than 180°.

In another preferred embodiment of the above method, the tape is a decorative tape. In yet another preferred embodiment of the above method, the tape is applied to a glass surface, where the tape provides a simulated beveled appearance.

BRIEF DESCRIPTION OF THE DRAWINGS

The present invention will be further explained with reference to the appended Figures, wherein like structure is referred to by like numerals throughout the several views, and wherein:

FIG. 4*a* is a top view of a first blade of the cutter of FIG. 3;

FIG. 4*b* is a top view of a second blade of the cutter of FIG. 3;

FIG. 4*c* is a top view of a third blade of the cutter of FIG. 3;

DETAILED DESCRIPTION OF THE INVENTION

Figure 1:
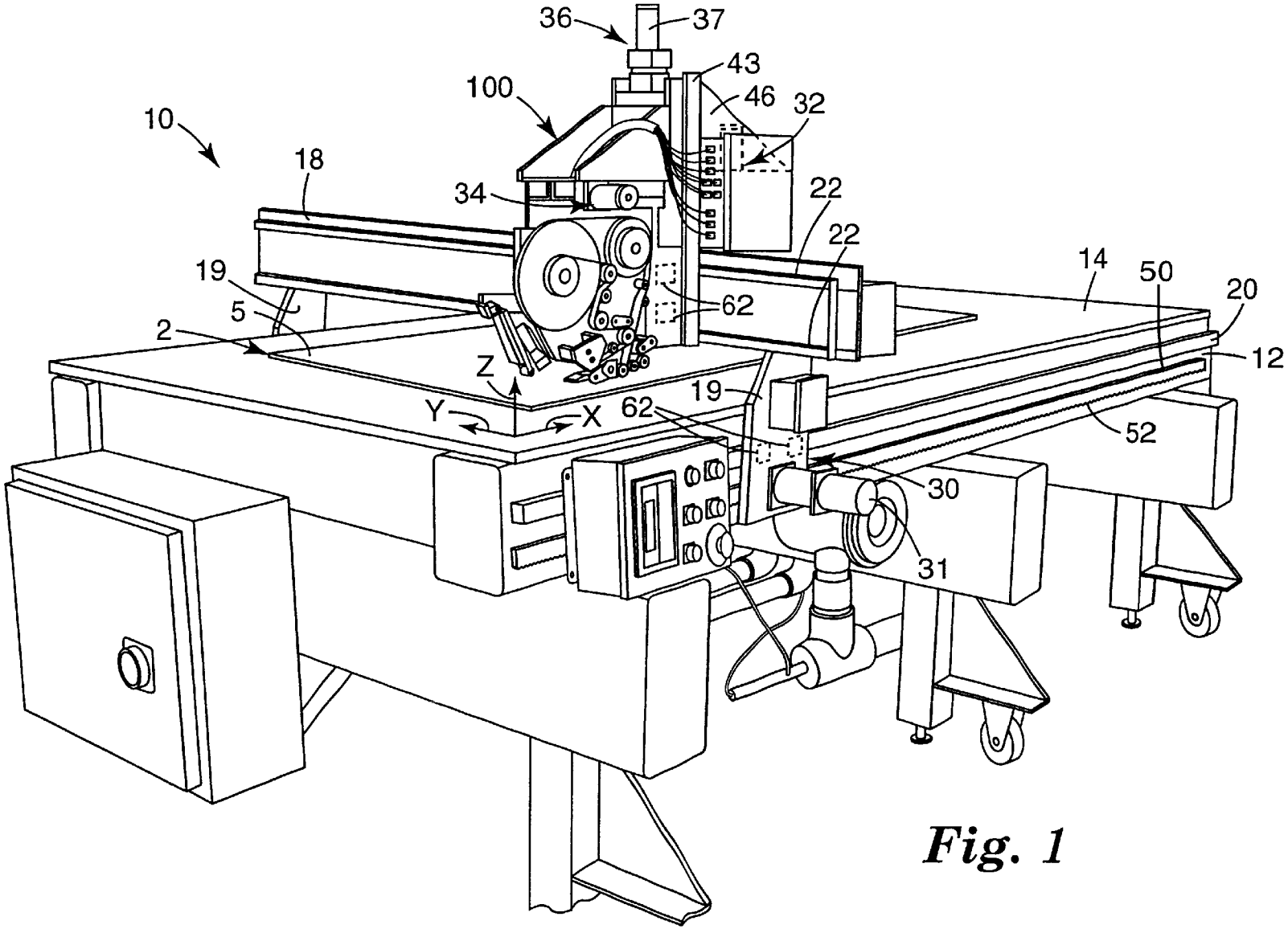
FIG. 1 is an isometric view of a preferred embodiment of the tape applicator of the present invention.

A preferred embodiment of a tape applicator 10 of the present invention is illustrated in FIG. 1. The tape applicator 10 includes a tape head 100 and a tabletop 14. With the use of actuators, the tape head 100 moves to different locations on the tabletop 14 to apply tape to an article on the tabletop 14, such as a sheet of glass 2. The tape head 100 first applies a first length of tape to a sheet of glass 2. As the tape head 100 is about to finish applying the first length of tape to the sheet of glass 2, the tape head cuts the tape to form a removable portion of the tape to thereby separate the first length of tape and a new second length of tape. Then, the tape head removes the removable portion of the tape and finishes applying the first length of tape. The tape head then moves to another location on the tabletop 14 to apply the second length of tape to the glass surface. The tape applicator 10 is especially useful for applying decorative tape. A particularly useful decorative tape is the type that includes optical film, as described in U.S. Pat. No. 5,840,407 in the Background Section, to form glass having a simulated etched, grooved, or beveled appearance. A layer of adhesive is on the optical film to form a tape. The tape is on a liner. The optical film may appear to have a single bevel or multiple bevels. For example, the optical film may appear to have a "V-groove." Such tapes having the optical film disclosed in U.S. Pat. No. 5,840,407 are commercially available as 3M™ Accentrim™ Tape, series B200 (V-groove tape) and series B100 (edge bevel tape), from 3M Company, located in St. Paul, Minn. However, with the benefits of the teachings herein, the applicator 10 may be adapted to apply any type of linered tape to any type of surface.

The tape applicator 10 preferably includes a frame 12 for holding the tabletop 14. The tabletop 14 includes an x-axis and a y-axis in the plane of the tabletop and a z-axis perpendicular to the tabletop 14. The tabletop 14 is preferably flat to allow a user to easily place a sheet of glass 2 on the tabletop 14. Optionally, the tape applicator may include an air system for blowing air above the tabletop 14 to allow a user to easily position the sheet of glass 2 on the tabletop 14. The tabletop 14 may also optionally include a vacuum system for holding the sheet of glass 2 stationary on the tabletop 14, once the sheet of glass 2 is correctly positioned. Such air and vaccum systems are well known in the art and need not be discussed further. The tabletop 14 and frame 12 are sized to handle desired sizes of glass and to support the tape head 100 and actuators 30, 32, 34, 36.

The tape applicator 10 includes a support arm 18 for supporting and moving the tape head 100 to different locations on the tabletop 14. The support arm 18 extends in the y-axis direction of the tabletop 14. The support arm 18 moves in the x-axis direction of the tabletop 14 along first sliding rods 20. The first sliding rods 20 are located on opposite sides of the frame 12. The support arm 18 includes legs 19 on opposite ends of the support arm. Each leg 19 includes at least one linear bearing 62, which allows the support arm 18 to move along the tabletop 14 in the x-axis direction along the first sliding rods 20. Each leg 19 includes an x-axis motor 31 for moving the support arm 18 in the x-axis direction. Each motor 31 is attached to a gear that engages with the gear teeth 52 of first gear racks 50. An example of the x-axis motor for the x-axis actuator is commercially available from Warner Electric, the Motors & Control Division, located in Ann Arbor, Mich. 48108 as the Warner Electric Slo-Syn DC Stepmotor Model M092 with SE34 gear head. The first gear racks 50 are located on opposite sides of the frame, extending along the x-axis direction, and are adjacent the first sliding rods 20.

The support arm 18 also includes second sliding rods 22 which are located along the support arm 18 facing the tape head 100, extending in the y-axis direction of the tabletop 14. The tape head 100 includes linear bearings 62 engaged with the second sliding rods 22 to allow the tape head 100 to move in the y-axis of the tabletop 14 along the second sliding rods 22 on support arm 18. The tape head 100 is moved along second sliding rods 22 by a y-axis actuator 32 (illustrated in FIGS. 2*b*–2*c*).

Figure 2A:
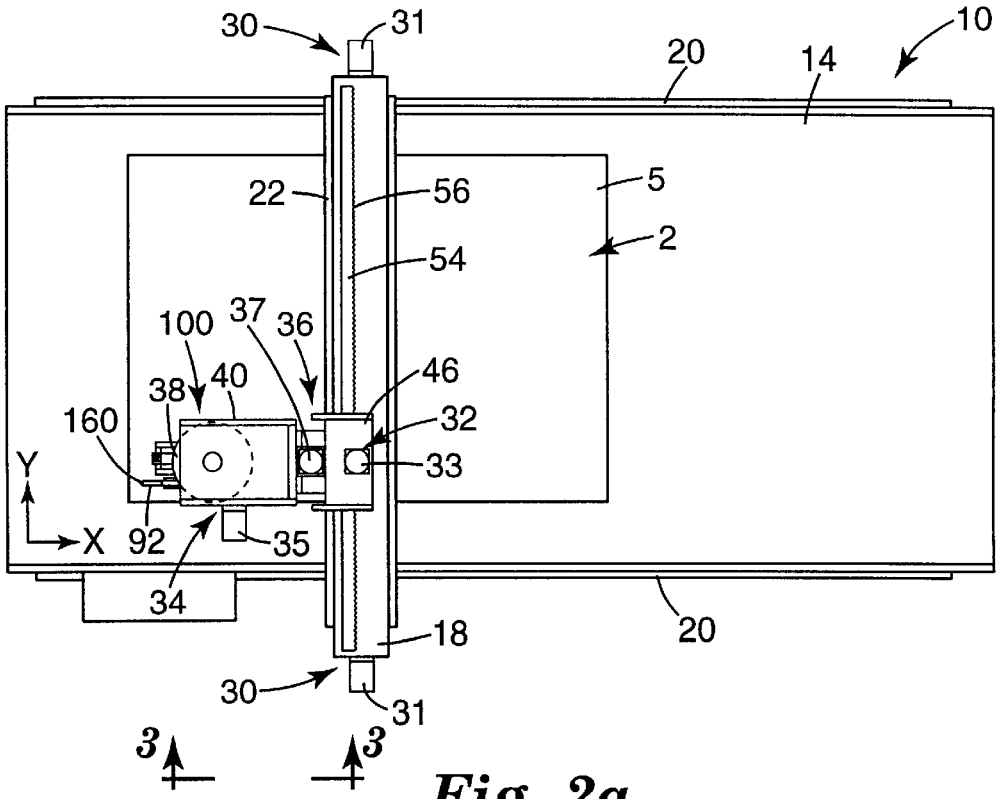
FIG. 2*a* is a top view of the tape applicator of FIG. 1 illustrating the tape head in a first position relative to the sheet of glass on the tabletop.
Figure 2B:
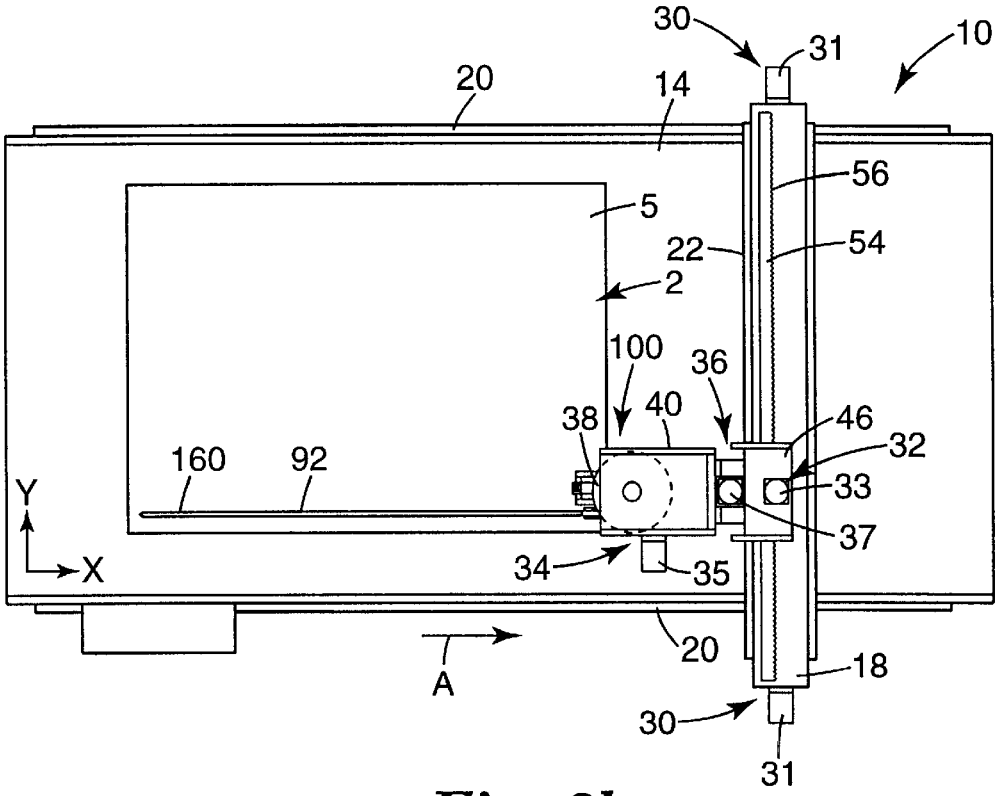
FIG. 2*b* is a top view of the tape applicator of FIG. 1 illustrating the tape head in a second position relative to the glass on the tabletop, after the tape head has applied a first length of tape to the sheet of glass.
Figure 2C:
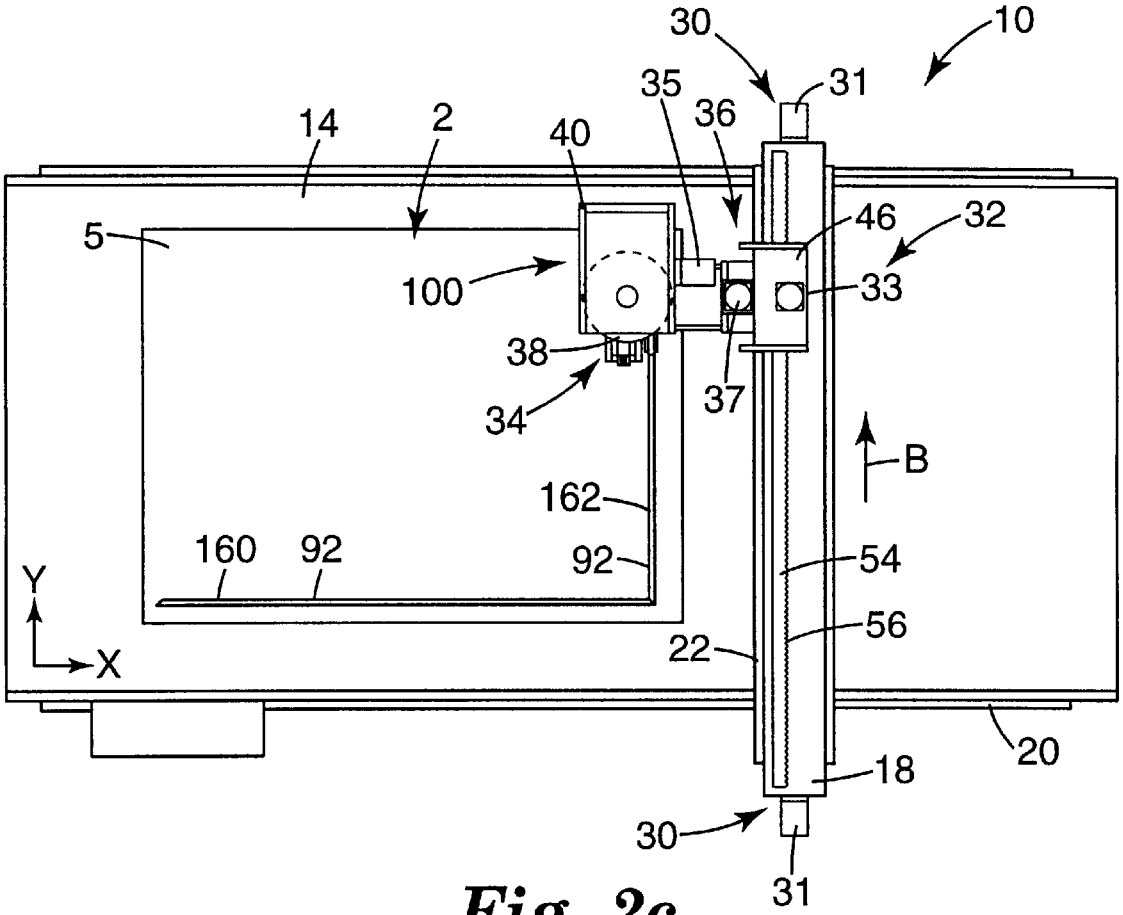
FIG. 2*c* is a top view of the tape applicator of FIG. 1 illustrating the tape head in a third position on the glass on the tabletop, after the tape head has applied a second length of tape to the sheet of glass.

FIGS. 2*a*–2*c* illustrate the tape head 100 moved to different locations, applying tape 92 to the sheet of glass 2 as the tape head 100 moves. To move the tape head 100 to a new location on the tabletop 14, the tape head may need to move in both the x-axis direction and the y-axis direction. To move the tape head 100 along the x-axis of the tabletop 14, the support arm 18 is driven along first sliding rods 20 by the x-axis actuators 30. To move the tape head 100 along the y-axis of the tabletop 14, the tape head is driven along second sliding rods 22 that are located along the support arm 18 by the y-axis actuator 32. The tape head 100 may move to a first location on the tabletop 14, start applying tape to the sheet of glass 2, and then the tape head 100 continues applying tape to the sheet of glass 2, as the tape head moves to a second location on the tabletop 14.

FIG. 2*a* illustrates the tape head 100 starting to apply a first length of tape 160. FIG. 2*b* illustrates the tape head 100 finishing applying the first length of tape 160. To move the tape head 100 as it is applying tape, the support arm 18 moves in the x-axis direction or in the direction of arrow A. The x-axis actuators 30 move the support arm 18 along first sliding rods 20. The x-axis actuators 30 each include an x-axis motor 31. The motor 31 is attached to a gear (not shown) that engages with the gear teeth 52 of the first gear rack 50. As the x-axis motors 31 turns the gear, the tape head moves down the gear rack 50 along tabletop 14 in the x-axis direction.

FIG. 2*c* illustrates the tape head 100 applying the second length of tape 162. The second length of tape 162 is perpendicular to the first length of tape 160. To begin applying the second length of tape, a rotary actuator 34, including a motor 35, rotated the tape head 100 counterclockwise 90° from its previous orientation shown in FIG. 2*b*. Then, the y-axis actuator 32 moved the tape head 100 in the y-axis direction or in the direction of arrow B along the second sliding rods 22 on support arm 18. As the tape head 100 moves in the y-axis direction, the tape head 100 applies the second length of tape 162. The y-axis actuator includes a y-axis motor 33. A second gear rack 54 extends along the y-axis direction, and is opposite the second sliding rods 22 on the support arm 18. The motor 33 is attached to a gear (not shown) that engages with the gear teeth 56 of the second gear rack 54. As the y-axis motor 33 turns the gear, the tape head moves down the gear rack 54 along the support arm 18 in the y-axis direction.

An example of the frame, tabletop, support arm, first and second sliding bars, first and second gear racks, x-axis actuator, and y-axis actuator, all illustrated in FIGS. 1 and 2*a*–2*c*, is commercially available from CNC Technologies, located in Fairplay, Colo., under trade name Camaster 48 including an X-Y Axis Microstepper Control System. Another example of the frame, tabletop, support arm, first and second sliding bars, first and second gear racks, x-axis actuator, and y-axis actuator, all illustrated in FIGS. 1 and 2*a*–2*c*, is commercially available from Larken Automation, located in Ottawa, Canada, as the Larken System 4000 CNC Router Table with Vacuum Table.

FIGS. 1, 2*a*, 2*b*, and 2*c* illustrate one embodiment of the frame and tabletop for supporting the sheet of glass. However, anything that provides the desired support for the sheet of glass is suitable. Also, FIGS. 1, 2*a*, 2*b*, and 2*c* illustrate one embodiment of the support arm and actuators 30, 32, 34, 36 for moving the tape head 100. However, anything that provides the movement of the tape head 100 along the x-axis, y-axis, z-axis or rotates the tape head 100 about the z-axis is suitable.

Figure 3:
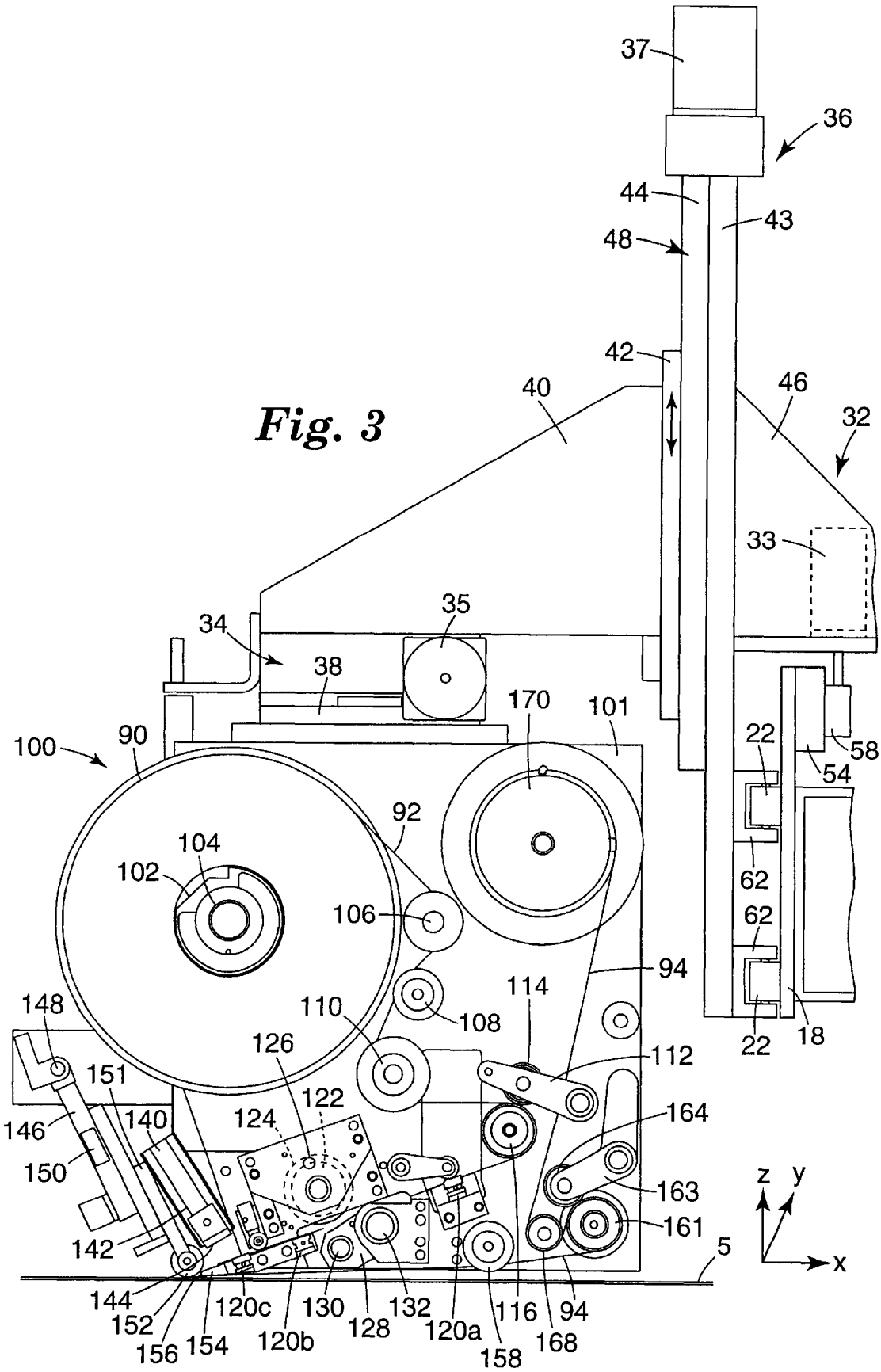
FIG. 3 is a side view of the tape head and support arm of FIG. 2*a* taken along line 3—3.

FIG. 3 is a side view of the support arm 18, y-axis actuator 32, z-axis actuator 36, rotary actuator 34 and tape head 100 taken along line 3—3 of FIG. 2*a*.

The y-axis actuator 32 moves the tape head 100 along support arm 18 in the direction of the y-axis of the tabletop 14. The tape head 100 is connected to the y-axis actuator by a vertical support 43 and by frame 46. The vertical support 43 and frame 46 slide along first sliding rods 22 supported by bearings 62. The y-axis actuator includes a y-axis motor 33 which is mounted inside frame 46. When the y-axis motor 33 turns, a gear 58 engages with the gear teeth of the second gear rack 54 mounted along the support arm 18, which in turn moves the frame 46 and ultimately the tape head 100 along the support arm 18 in the y-axis direction of the tabletop 14. An example of the y-axis motor for the y-axis actuator is commercially available from Warner Electric, the Motors & Control Division, located in Ann Arbor, Mich. 48108 as the Warner Electric Slo-Syn DC Stepmotor Model M092 with SE34 gear head.

The z-axis actuator 36 moves the tape head 100 up and down relative to the vertical support 43 along the z-axis of the tabletop 14. The z-axis actuator 36 includes a linear positioning table 48 and a z-axis motor 37. The frame 40 is mounted to the slider 42 of the linear positioning table 48. When the motor 37 turns, the slider 42 and frame 40 move up or down along a third sliding rod 44, which in turn moves the tape head 100 up or down along the z-axis. An example of the z-axis motor for the z-axis actuator is commercially available from Warner Electric, Motors & Control Division, located in Ann Arbor, Mich., as the Slo-Syn DC Stepmotor M062. An example of the linear positioning table 48 for the z-axis actuator is commercially available from Parker Hannifin Corp., located in Cleveland, Ohio, as a linear positioning table under model number 406100XRMS-D2-H3L4C2M3E5RIB2P1.

The rotary actuator 34 rotates the tape head 100 around the z-axis of the tabletop 14. The rotary actuator 34 connects the tape head 100 to the frame 40. The rotary actuator 34 includes a motor 35 and a rotary table 38. When the motor 35 turns, it rotates the rotary table 38, which in turn rotates the tape head 100 about the z-axis. An example of the rotary actuator 34 is commercially available from Parker Hannifin Corporation, located in Cleveland, Ohio, as a rotary positioning table sold under part number 20601RT-ES-H2C6M1E1.

FIG. 3 illustrates the first side of the tape head 100. The tape head 100 includes a base 101. The tape head 100 includes a tape roll holder 102. The tape roll holder 102 is for receiving a roll 90 of tape 92. The tape 92 from the roll 90 follows a tape path through the tape head 100 from the tape roll holder 102 until where the tape is eventually applied to a surface. The tape 92 includes a backing and a layer of adhesive on the backing. The tape 92 is on a liner 94. The tape roll holder 102 preferably includes a friction clutch 104 to provide back tension on the tape 92 as it unwinds from the tape roll 90, so the tape does not continue to unwind from the roll 90 when the tape head 100 stops applying tape to the surface.

The tape head 100 also includes an unwind roller 106, a first tape guide roller 108, a second tape guide roller 110, a first arm 112 with a nip roller 114, and a tension roller 116, all attached to the base 101. The unwind roller 106 preferably includes a motor (not illustrated) to drive the roller 106, so as to pull tape 92 from the roll of tape 90. The nip roller 114 and the tension roller 116 form a nip for the tape 92 to travel through. The tape head 100 also includes three spring-loaded tape guides 120*a,* 120*b,* 120*c,* and a bed roller 130 that pivots about shaft 132, and a cutter 122. The cutter 122 and the bed roller 130 are located opposite each other on the tape path. The cutter 122 includes a plurality of blades 124, which are more clearly shown in FIG. 4.

The tape head also includes an arm 146 that pivots about shaft 148. The arm 146 includes an applying roller arm 151 and a remover 140 attached to the arm 146. The applying roller arm 151 includes an application roller 152 mounted on the end of it. The arm 146 also includes a first actuator 150 for moving the applying roller arm 151 and remover 140 up or down relative to the arm 146, to place the application roller 152 in contact with the tape 92 and a surface 5 or to place the remover 140 in contact with a removable portion of tape (as explained in more detail with reference to FIGS. 6–11). The arm 146 also includes a second actuator (not shown) for pivoting the arm 146 clockwise and counter clockwise about shaft 148. Preferably, the first actuator 150 and the second actuator include the use of air cylinders. The tape head 100 also includes a platen 154 with an edge 156. Alternatively, the platen 154 may include a roller instead of an edge 146. The platen 154 is located opposite the remover 140 and the application roller 152 along the tape path. The platen 154 includes the second and third spring-loaded tape guides 120*b,* 120*c*.

The tape head 100 includes a liner path from the edge 156 of the platen 154 to a liner take-up roller 170. This is the path that the liner 94 follows after the tape 92 is separated from the liner 94 at the edge 156 of the platen 154. Along this liner path, the tape head 100 includes a first liner guide roller 158, a driven roller 161, a nip roller 164 mounted on the end of a second arm 163, a wrap roller 168, all mounted to the base 101. The driven roller 161 includes a motor (not illustrated). The driven roller 161 and the nip roller 164 form a nip for the liner 94 to travel through. Preferably, the liner take-up roller 170 includes a motor (not illustrated) to drive the roller 170, so as to wind the liner 94 around the roller 170. The liner take-up roller 170 preferably includes a friction clutch to provide tension on the liner 94 as it winds onto the liner take-up roller 170, to keep the liner 94 taunt.

The tape 92 preferably moves along the following tape path within the tape head 100: a) from the tape roll holder 102 to the driven unwind roller 106; b) then to the first tape guide roller 108; c) then to the second tape guide roller 110; d) then to the nip formed between the nip roller 114 and the tension roller 116; e) then to the first spring-loaded tape guide 120*a;* f) then between the bed roller 130 and cutter 122; g) then to the second and third spring-loaded tape guides 120*b,* 120*c;* h) then between the platen 154 and remover 140; and i) then under the application roller 152, which applies the tape 92 to the surface 5. The edge 156 of the platen 154 helps separate the liner 94 from the tape 92, as the tape 92 passes over the edge 156 and the liner 94 is pulled in a direction opposite the tape 92 being applied to the surface. After the liner 94 is separated from the rest of the tape 92, the liner 94 moves along the following path within the tape head 100: a) from the edge 156 of platen 154 to the first liner guide roller 158; b) then to the nip formed between the driven roller 161 and the nip roller 164; c) then to the wrap roller 168; and d) then to the driven liner take-up roller 170.

When loading a new roll of tape 90 into the tape head 100, the tape is initially threaded through the tape head 100 according to the tape path outlined above. The first arm 112 is first pivoted clockwise to allow the tape to be wound around the tension roller 116. Then, the first arm 112 is pivoted counter clockwise to form the nip between the nip roller 114 and the tension roller 116 with the tape in the nip. The spring-loaded tape guides 120*a,* 120*b,* 120*c* each include two sides contacting the opposite edges of the tape. One side is stationary and the other side is slideable, yet biased with a spring against that edge of the tape. The spring-loaded side is pulled away slightly to allow the tape to pass through the tape guides 120*a,* 120*b,* 120*c*. Then, the spring-loaded side is released. The tape guides 120*a,* 120*b,* 120*c* assist in keeping the tape 92 straight just prior to its application to the surface 5 by the application roller 152. The spring-loaded tape guides 120*b,* 120*c* of the platen are preferably aligned with the spring loaded tape guide 120*a*. Next, the liner 94 is separated from the rest of the tape 92 near the edge 156 of the platen 154. The edge 156 of the platen 154 is preferably sharp to assist in separating the liner 94 from the rest of the tape 92. The liner is then wound through the tape head 100 according to the liner path outlined above and around the liner take-up roller 170.

Figure 4:
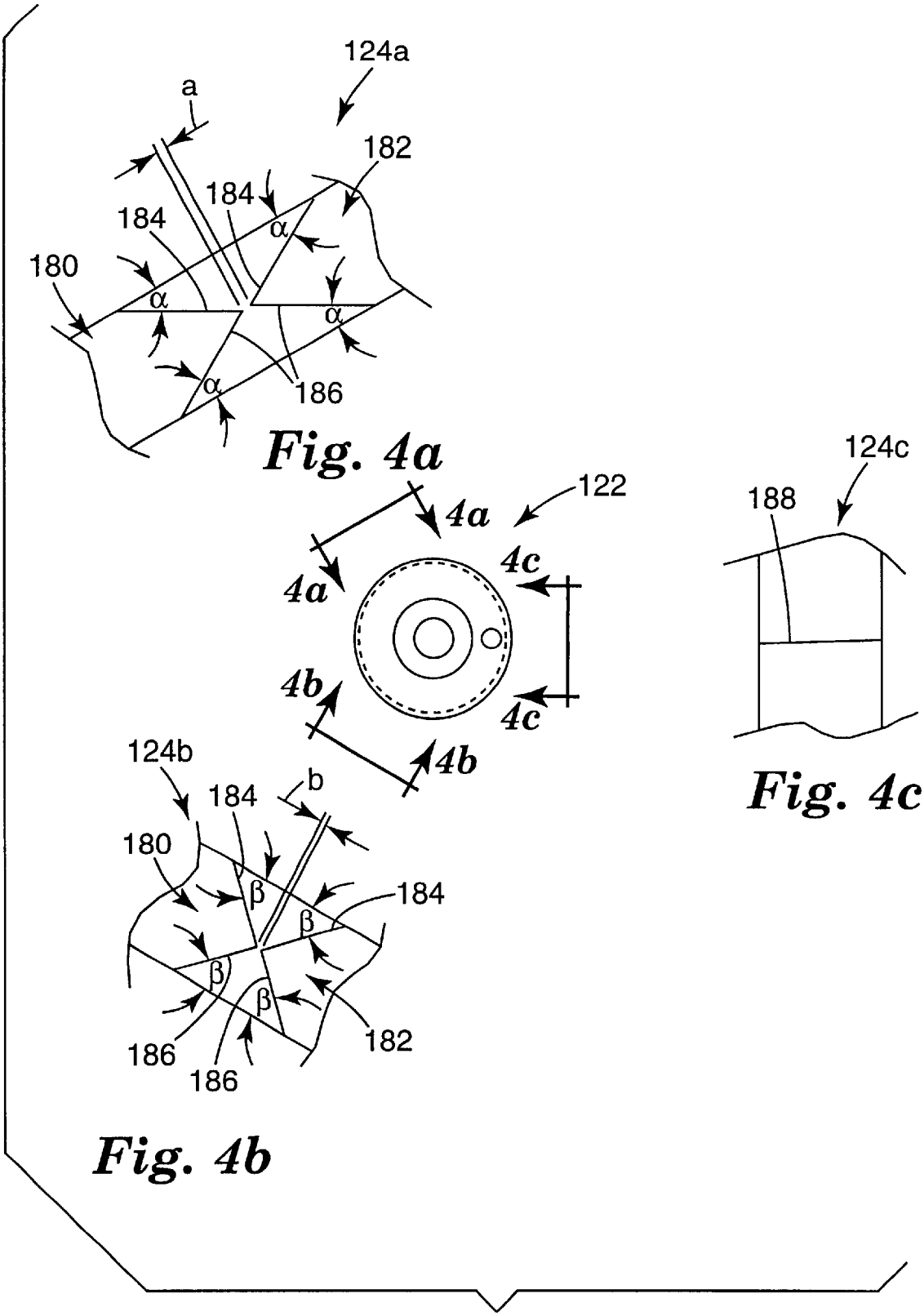
FIG. 4 is a side view of the rotary die of the tape head of FIG. 3.

FIG. 4 illustrates one embodiment of cutter 122. In this embodiment, the cutter is a rotary die and it is configured to cut a plurality of shapes to form removable portions of tape. However, other means of cutting known in the art may be used to cut the removable portions of tape. In this embodiment the rotary die is configured to cut three different shapes into the tape 92. However, the rotary die 122 may be configured to cut any number of shapes. Each shape includes a different blade configuration. The first blade configuration 124*a* cuts a "butterfly" shape in the tape to form a removable portion of tape. The first blade configuration 124*a* includes a first angled blade 180 and a second angled blade 182 opposite the first angled blade 180. Both the first angled blade 180 and the second angled blade 182 are in the shape of a "V" with the point of the "V" pointing at each other. The first angled blade 180 and second angled blade 182 are set a distance "a" away from each other at their points. Each angled blade 180, 182 includes a first oblique side 184 and a second oblique side 186. The oblique sides 184, 186 are set at an angle $\alpha$ relative to the longitudinal axis of the cutter 122. Angle $\alpha$ may be selected for a desired appearance in the blade configuration. For example, angle $\alpha$ may be 30°, 45°, or 60° or any other angle. Alternatively, each angled blade 180, 182 may include different angles $\alpha$. In one preferred embodiment, the angle $\alpha$ is 30°. Preferably, the distance "a" is between 0.5 mm and 4 mm. More preferably, the distance "a" is between 2 mm and 2.3 mm. The second blade configuration 124*b* is the same as the first blade configuration 124*a,* except that in a preferred embodiment, the angle $\beta$ is 45° and the distance "b" is preferably between 0.3 mm and 3 mm, and more preferably between 0.3 mm and 0.5 mm. Alternatively, the angle β may be 30° or 60° or any other angle. The second blade configuration 124*b* also cuts the tape to form a removable portion of tape in the shape of a butterfly. The third blade configuration 124*c* includes a single blade 188, which is perpendicular to the longitudinal axis of the cutter. With this blade, a removable portion of tape is not formed. Preferably the blade configurations 124 are equidistant around the cutter 122 or 120° relative to each other.

Even though the blade configurations illustrated in FIGS. 4*a*–4*c* are illustrated as having straight blades, the blades may be in any shape to provide for a variety of shapes in the removable portions.

Referring back to FIG. 3, the rotary die 122 is rotated about its axis by a motor (not illustrated.) A sensor 126 senses a reference mark on the rotary die 122 to locate the home position of the rotary die. Based on that home position, the motor rotates the rotary die until it aligns a desired one of the blade configurations 124 along the tape 92. Once the selected blade configuration is close to being directly over the tape, the bed roller 130 pivots about shaft 132 to provide support for the tape about to be cut.

Figure 5A:
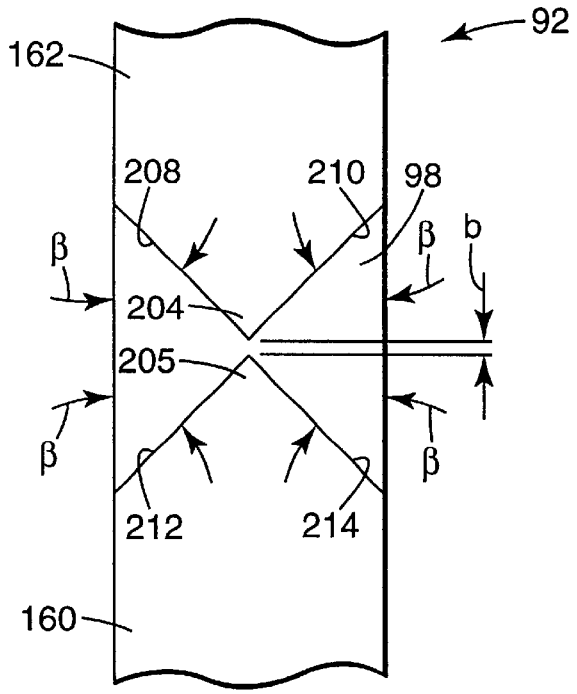
FIG. 5*a* is a top view of the tape after it has been cut by the second blade of the cutter illustrated in FIG. 4*b*, forming one embodiment of the first removable portion of the tape.

FIG. 5*a* is a top view of the tape 92 after it has been cut by the second blade configuration 124*b* of the cutter 122. The second blade configuration 124*b* forms a first length of tape 160, a second length of tape 162, and a removable portion 98 between the first length of tape 160 and the second length of tape 162. In this case, the first removable portion 98 is in a shape similar to a butterfly. Each end of the first and second lengths of tape 160, 162 is angled to form angled ends 204, 205. The first angled end 204 of the second length of tape 162 has a first oblique side 208 and a second oblique side 210. The second angled end 205 of the first length of tape 160 has a first oblique side 214 and a second oblique side 212. The first angled end 204 and second angled end 205 are cut at an angle β relative to the length of the tape. Preferably, the angled ends 204, 205 are cut to fit together to give the desired intersection 220, as illustrated later in FIGS. 12*a* and 12*b*. Angle β may be selected for a desired appearance. For example, angle β may be 30°, 45°, or 60° or any other angle. Alternatively, each angled end 204, 205 may include different angles. There is a distance "b" between the first angled end 204 of the second length of tape and the second angled end 205 of the first length of tape 160. Preferably, the distance "b" is between 0.3 mm and 3 mm. More preferably, the distance "b" is between 0.3 mm and 0.5 mm.

Figure 5B:
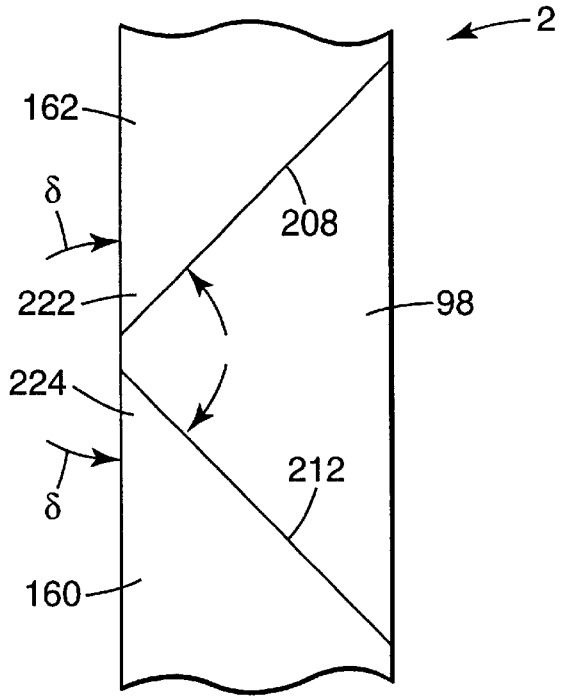
FIG. 5*b* is a top view of the tape after it has been cut by an alternative embodiment of the blade of the cutter (not illustrated), forming an alternative embodiment of the first removable portion of the tape.

FIG. 5*b* is a top view of the tape 92 after it has been cut by an alternative blade configuration (not illustrated) of the cutter 122. In this embodiment, the blade configuration also forms a first length of tape 160, a second length of tape 162, and a removable portion of tape 98. In this case, the first removable portion 98 is in a shape similar to a triangle. Each end of the first and second lengths of tape 160, 162 is angled to form angled ends 222, 224. The first angled end 222 of the second length of tape 162 has only one oblique side 208. The second angled end 224 of the first length of tape 160 has only one oblique side 212. The first angled end 222 and second angled end 224 are cut at an angle δ relative to the length of the tape. Preferably, the angled ends 222, 224 are cut to fit together to give the desired intersection 230, as illustrated later in FIG. 12*c*. Angle δ may be selected for a desired appearance. For example, angle δ may be 30°, 45°, or 60° or any other angle. Alternatively, each angled end 222, 224 may include different angles.

FIGS. 6–11 are useful for describing the method of applying a first length of tape to the surface 5 of a sheet of glass 2, cutting a removable portion tape, removing the removable portion of tape, and applying the second length of tape to the surface 5 of the sheet of glass 2.

Figure 6:
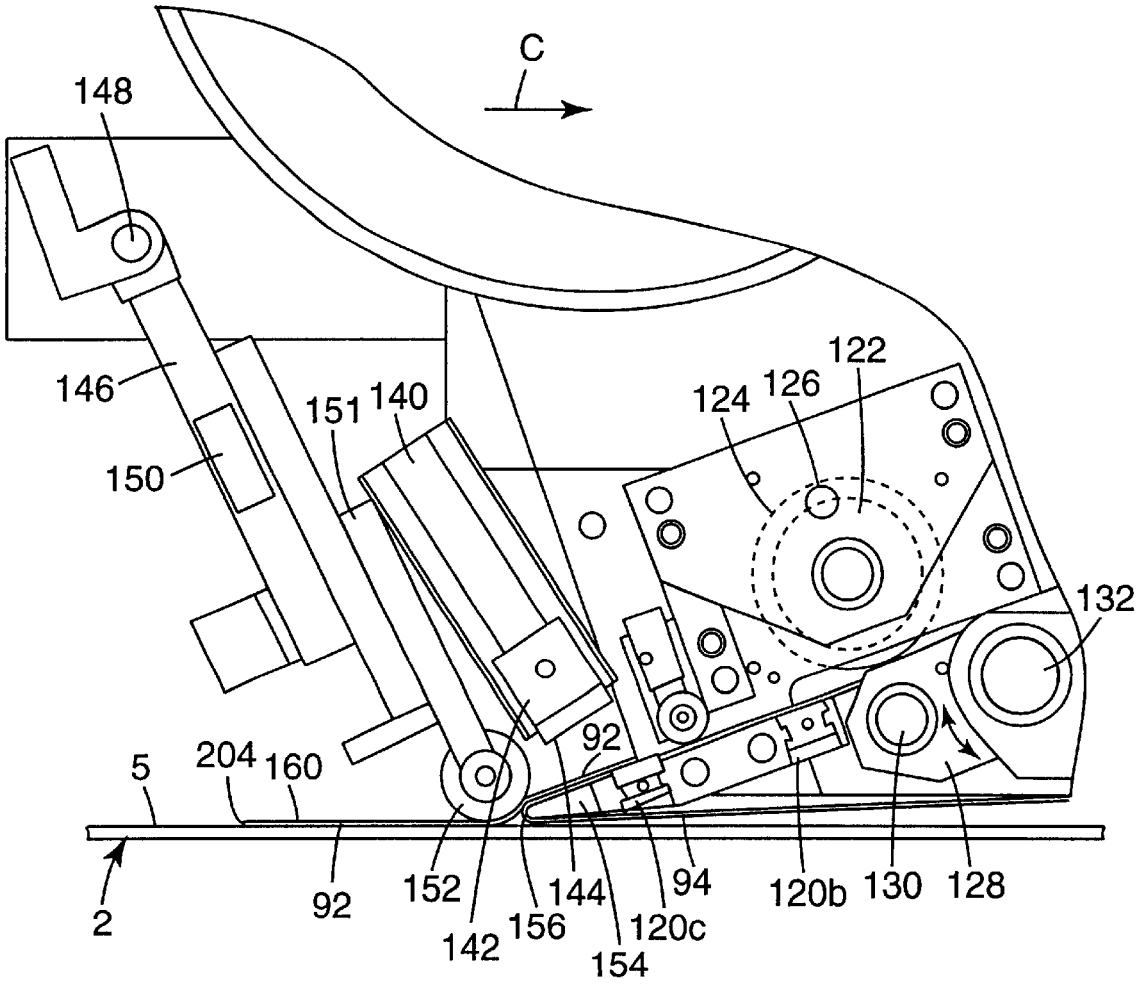
FIG. 6 is a partial side view of the tape head of FIG. 3, illustrating a first length of tape being applied to the sheet of glass by the tape application roller.

FIG. 6 is a partial side view of the tape head 100. Tape head 100 is applying a first length of tape 160 with a first end 204 on the surface 5 of the sheet of glass 2 in the direction of arrow C. Preferably, the first end 204 was previously cut to provide a desired angled end, however, this is not essential. Preferably, the tape head 100 is moved relative to the stationary glass surface 5 in the direction of arrow C by the x-axis or y-axis actuators, as explained above. It is also possible to move the glass relative to the stationary tape head or to move both the glass and the head. As the tape head 100 moves relative to the glass surface 5, the tape application roller 152 presses the tape 92 against glass surface, adhering the adhesive side of the tape 92 to the glass surface. During this motion of the tape head 100, the remover 140 is at a remote position, located away from the tape 92 and liner 94. Also during this motion of the tape head 100, the bed roller 130 is pivoted counterclockwise about shaft 132 at a remote position, located away from the tape 92 and liner 94. As the tape head 100 is close to finishing applying the first length of tape 160, the rotary die 122 rotates clockwise about its axis to start aligning one of the blade configurations 124*a*–124*c* with the tape. When the selected blade configuration 124 is just about to make contact with the tape 92 and liner 94, the bed roller 130 pivots clockwise about pivot 132 to provide a support surface for the tape 92 and liner 94. Then, the selected blade configuration 124 of rotary die 122 cuts the tape 92 to form a removable portion 98, as the rotary die continues it rotation about its axis. Preferably, the rotary die 122 pivots at approximately the same speed as the tape 92 is moving past the rotary die 122. This is to allow the tape 92 to continue to move at the same speed without disruption by the rotary die 122. Preferably, the rotary die 122 forms the removable portion 98 by cutting through the tape 92, but not cutting through the liner 94. This is to allow the removable portion 98 to stay adhered to the liner 94 until it is removed from the liner by the remover 140 in the next steps of the process, illustrated in FIGS. 7–9.

As the tape head 100 finishes applying the first length of tape 160 to the glass surface 5, the tape head 100 continues to move in the same direction, by the x-axis actuator 30 or y-axis actuator 32, whichever is appropriate, until the application roller 152 rolls over the second end 205 of the first length of tape 160. Next, the x-axis actuator 30 or y-axis actuator 32 moves the tape head 100 to position the platen 154 directly above where the tape head will start applying the first end 204 of the second length of tape 162 on the glass surface 5.

Figure 7:
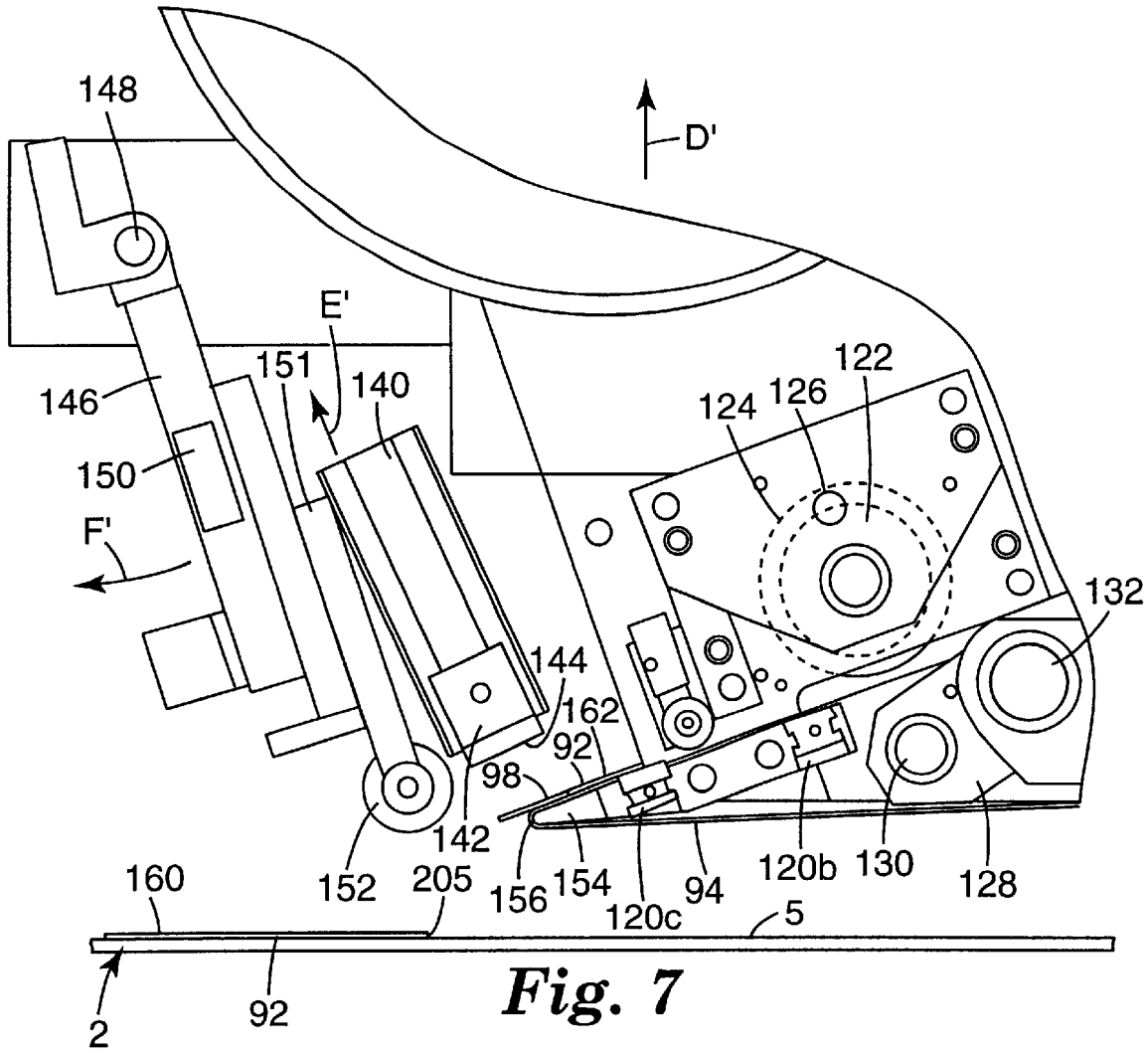
FIG. 7 is a partial side view of the tape head of FIG. 3, after the first length of tape is applied to the sheet of glass.

FIG. 7 illustrates the next series of steps. The removable portion 98, which is located between the first length of tape 160 and the second length of tape 162, is now positioned on the platen 154. Preferably, the middle of the removable portion 98 is positioned over the edge 156 of the platen 154. First, the z-axis actuator 36 moves the tape head 100 in the direction of arrow D', which is up relative to the glass surface 5. Second, an air cylinder (not shown) actuates the arm 146 clockwise in the direction of arrow F', thus pivoting both the remover 140 and applying roller arm 151 clockwise. At about the same time, another air cylinder (not shown) actuates both the remover 140 and the applying roller arm 151 in the direction of arrow E', which is up relative to the arm 146. The surface 144 of the slider 142 of the remover 140 is now positioned directly over the removable portion 98. Alternatively, the adhesive could be replaced by a vacuum source or some other mechanical structure for retaining the removable portion 98 of tape.

Figure 8:
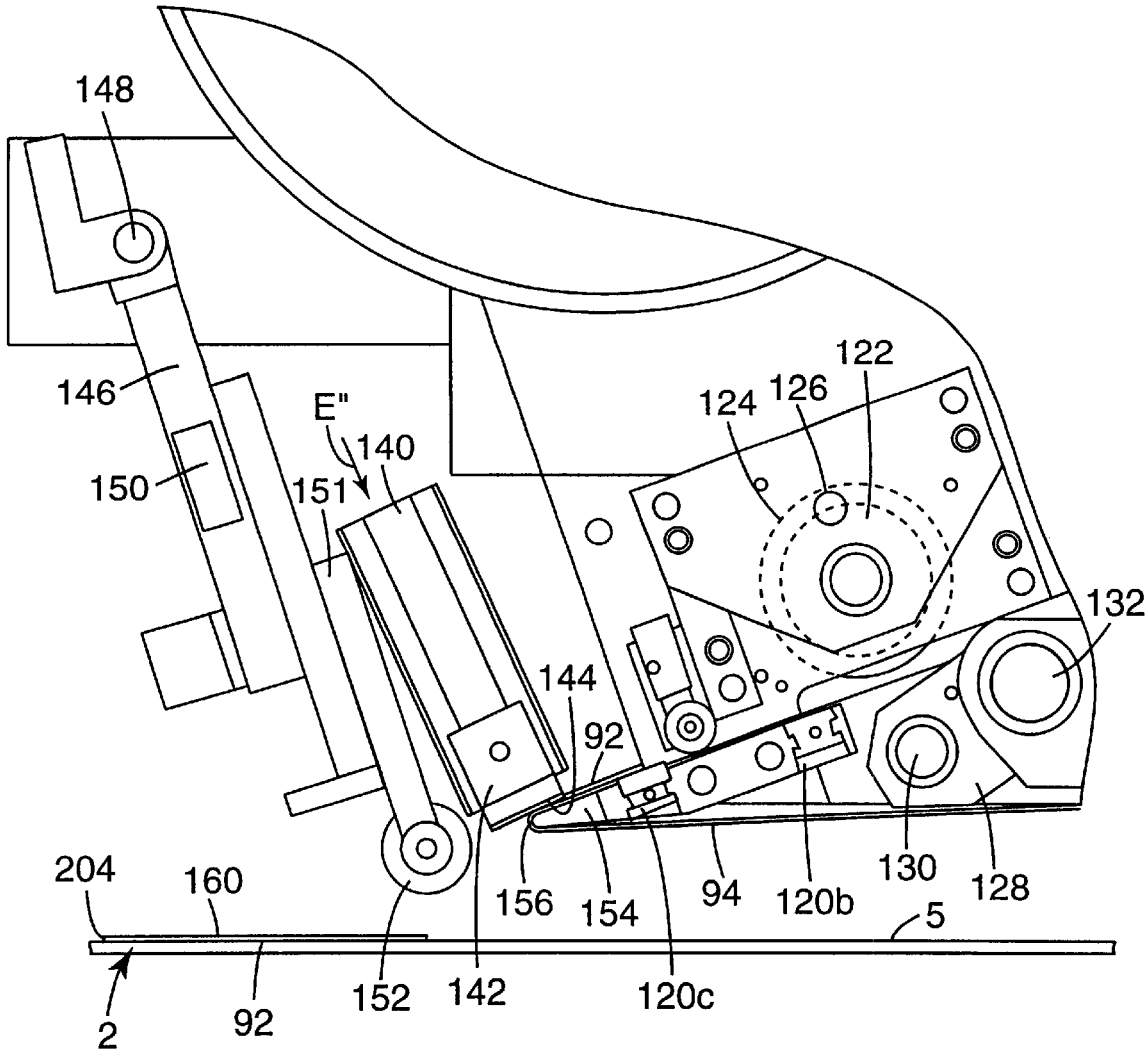
FIG. 8 is a partial side view of the tape head of FIG. 3, illustrating the remover adjacent the first removable portion of the tape.

FIG. 8 illustrates the next step. In this step, the air cylinder (not shown) actuates both the remover 140 and the applying roller arm 151 down relative to the arm 146 in the direction of arrow E" to pick up the removable portion 98 from the platen 156. Preferably, the surface 144 on the slider 156 has a piece of double-stick adhesive tape on it. The adhesive layer facing outwards from the surface 144 sticks to the backing of the removable portion 98 of tape.

Figure 9:
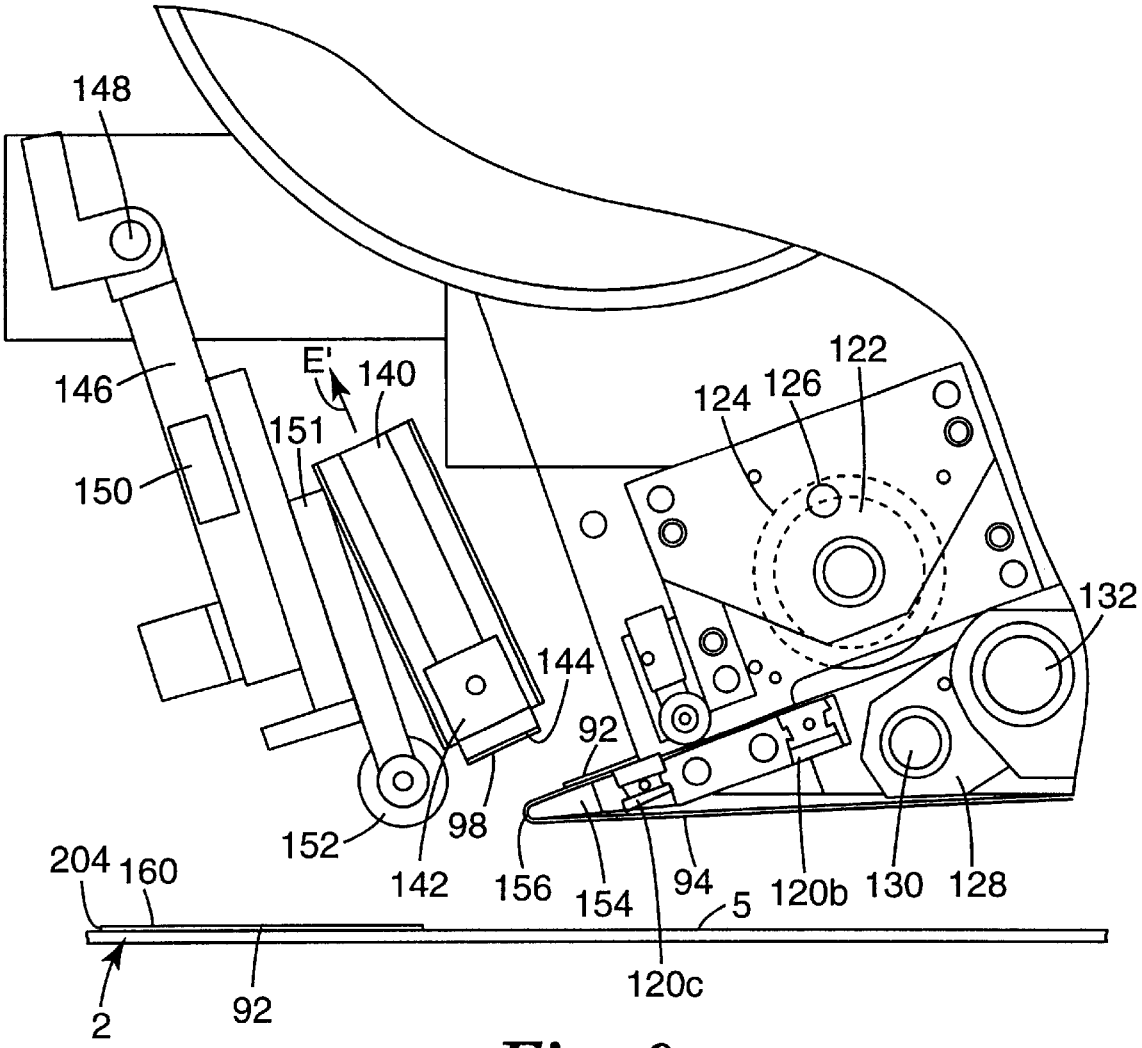
FIG. 9 is a partial side view of the tape head of FIG. 3, illustrating the remover after it has removed the first removable portion of the tape from the liner.

FIG. 9 illustrates the next step. In this step, the air cylinder (not shown) actuates both the remover 140 and the applying roller arm 151 back up relative to the arm 146 in the direction of arrow E', to remove the removable portion 98 of tape from the liner 94.

Figure 10:
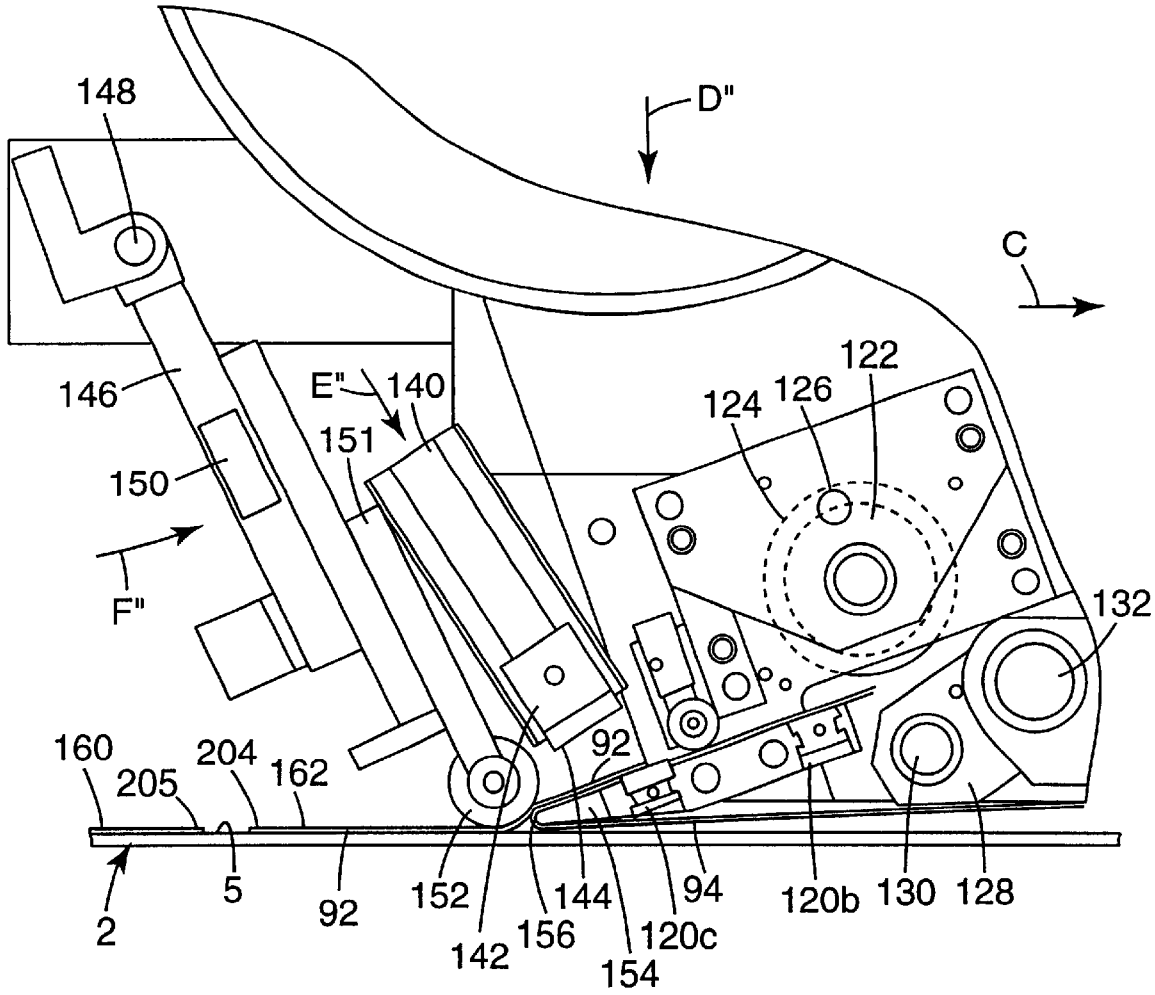
FIG. 10 is a partial side view of the tape head of FIG. 3, illustrating a second length of tape applied to the sheet of glass by the tape application roller, after the first removable portion of tape has been removed.

FIG. 10 illustrates the next series of steps. First, the air cylinder (not shown) actuates both the remover 140 and the applying roller arm 151 down relative to the arm 146 in the direction of arrow E". At about the same time, the air cylinder (not shown) actuates the arm 146 counter-clockwise in the direction of arrow F", thus pivoting both the remover 140 and applying roller arm 151 counter-clockwise. Second, the z-axis actuator 36 moves the tape head 100 down relative to the glass surface 5 in the direction of arrow D". After this sequence of steps, the application roller 152 is positioned directly in front of the platen 154. Third, the x-axis actuator or y-axis actuator starts moving the tape head 100 relative to the glass surface 5 in the direction of arrow C. As the tape head 100 moves, the second length of tape 162 is applied to the glass surface 5 by the application roller 152. However, these steps may be performed in any sequence.

Figure 11:
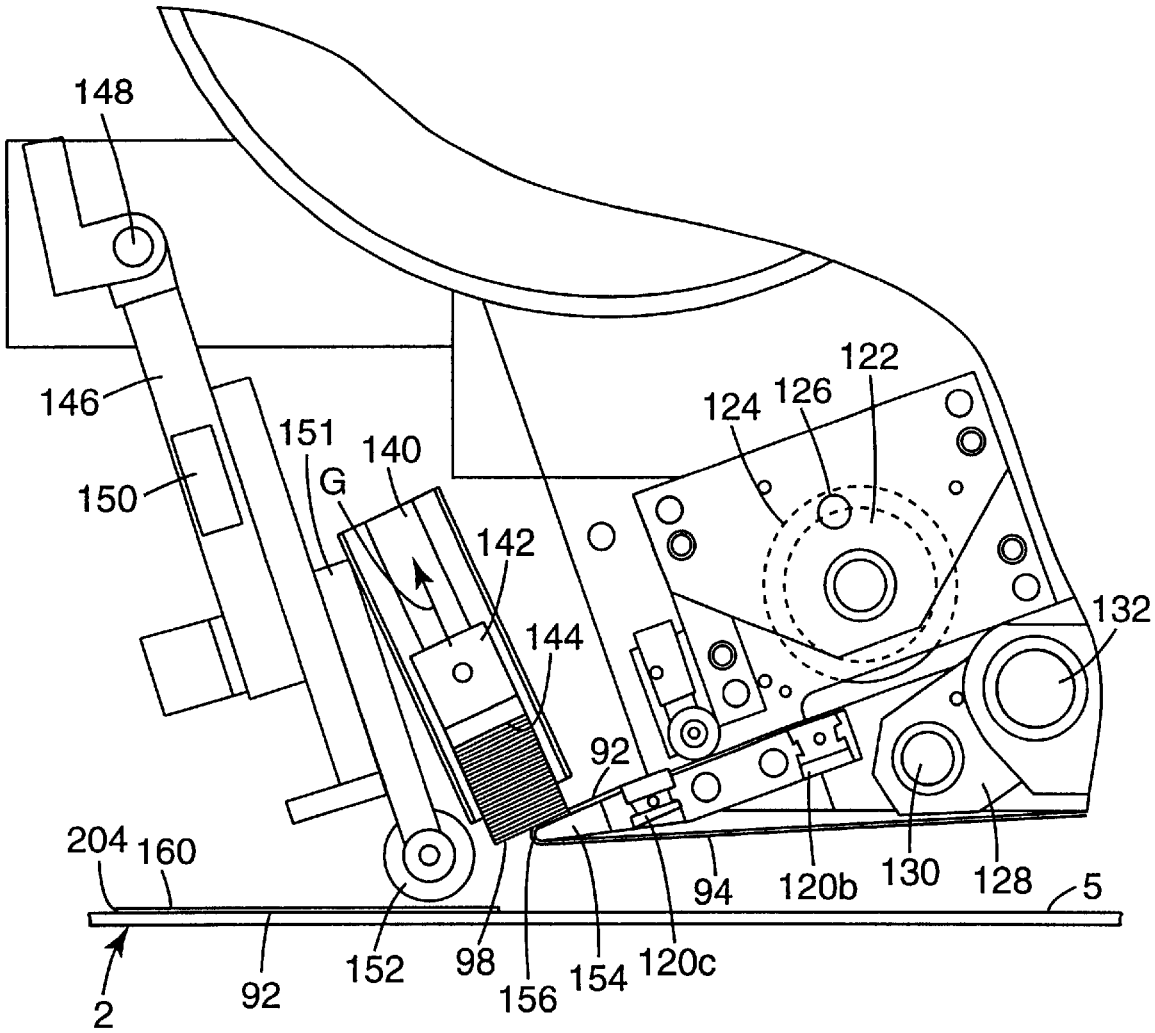
FIG. 11 is a partial side view of the tape head of FIG. 3, illustrating the tape applied to the sheet of glass by the tape application roller, after a plurality of removable portions of tape have been removed.

The steps illustrated in FIGS. 6–10 are repeated until the desired amount of tape is applied to the surface at its desired locations. During this time, the removable portions 98 of tape are accumulated by the remover 140, creating a stack of removable portions 98 as shown in FIG. 11. In this stack, the adhesive side of one of the removable portions 98 of tape is adhered to the backing of an adjacent removable portion 98 of tape. As more and more removable portions 98 are accumulated, the stack becomes thicker. As the remover 140 is pressed down against the removable portion 98 of tape on the liner, the slider 142 moves successively to different positions within the channel of the remover 140 in the direction of arrow G. When the stack of removable portions 98 has filled most of the channel of the remover 140, the stack of removable portions 98 is removed from the channel, and the slider 142 slid back down the channel to start the process again. Alternatively, the remover 140 may then be disengaged from the tape head and the stack of removable portions 98 may be removed.

To operate the x-axis actuator 30, y-axis actuator 32, rotary actuator 34, and z-axis actuator 36 to move the tape head 100, the tape applicator 10 preferably includes a controller for sending signals to the actuators 30, 32, 34, 36 as where to move the tape head 100 relative to the tabletop 14. For instance, a user may want to apply decorative tape to the sheet of glass 5 in the patterns illustrated in one of FIGS. 12*a*–12*c*. The user enters a set of commands into the controller as to what the tape layout should look like. The controller then determines which way to direct the actuators 30, 32, 34, 36 to move the tape head 100 to apply the tape to the glass and to select the appropriate blade configurations in the cutter to cut the tape before it has been applied. The controller preferably includes an "open loop" system, which calculates where the tape head 100 is located on the tabletop 14, based on a known series of moves. For example, the gear in either the x-axis actuator 30 or y-axis actuator 32 will move the tape head 100 a known distance per one rotation of the gear along the gear rack. If the controller knows the initial location of the tape head 100, it can determine where the final location of the tape head 100, based on how many rotations the gear in the actuator rotated along the gear rack. The controller will send a signal to the x-axis and y-axis actuators 30, 32 to turn the gears a certain number of rotations to move the tape head 100 a certain distance in a particular axis. The controller can also send signals to the z-axis actuator 36 to move the tape head 100 up or down the z-axis. The controller can also send signals to the rotary actuator 36 as to where to rotate the tape head 100 relative to the z-axis of the tabletop 14. A suitable controller is a controller sold under the trade name Compumotor, which is commercially available from Braas Company located in St. Paul, Minn., sold under part number 6K8.)

Alternatively, the controller could include a "closed loop" system, which provides continuous feedback as to the location of the tape head 100 on the tabletop 14.

To determine the initial location of the tape head 100 on the tabletop 14, the actuators 30, 32, 34 preferably include sensors to determine the location. Suitable sensors for the actuators 30, 32, 34 are proximity sensors sold under the trade name Omron, which is commercially available from Braas Company located in St. Paul, Minn., sold under part number E2E-X1R5E1-M1-N.

Figure 12A:
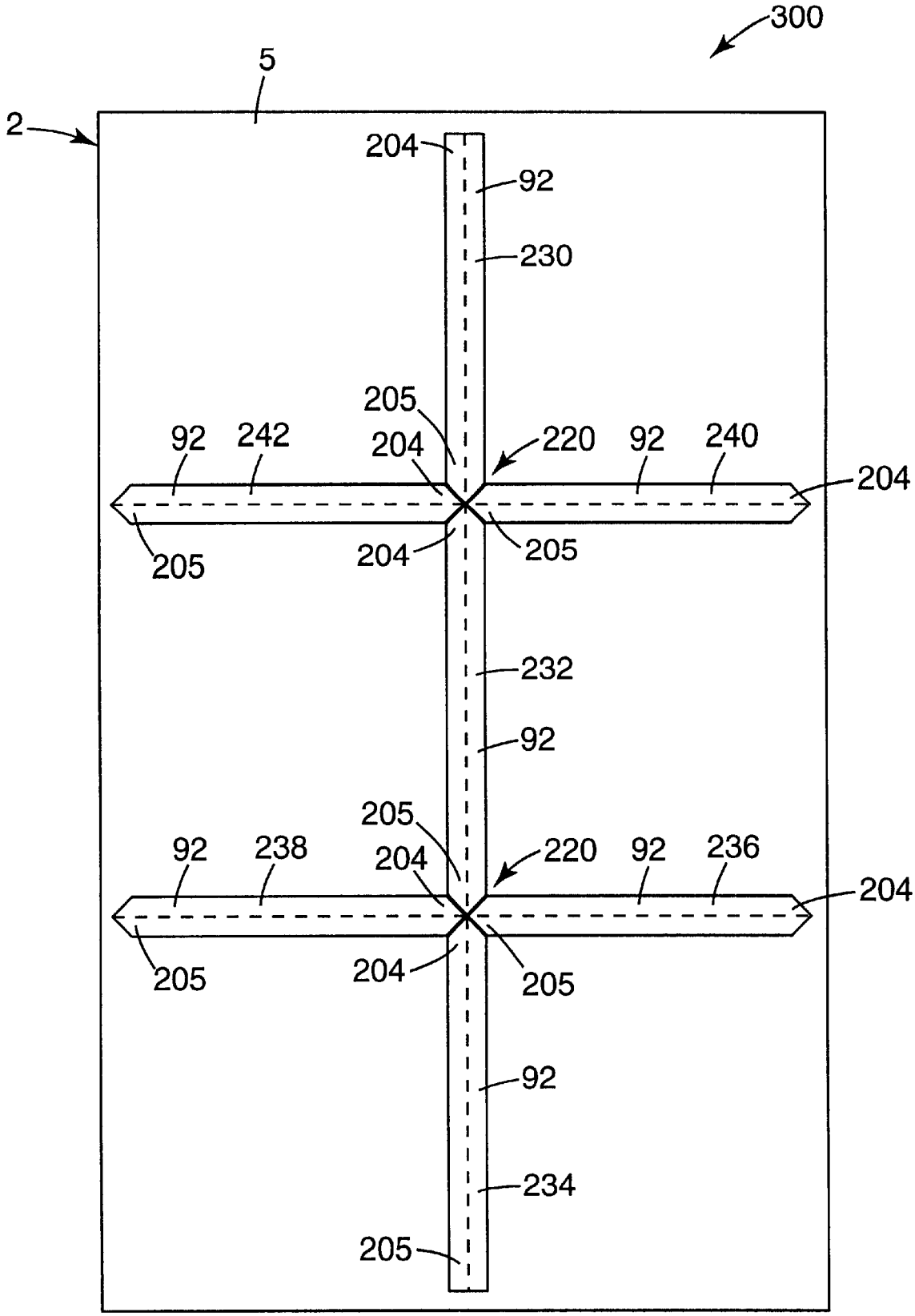
FIG. 12*a* illustrates one preferred arrangement of a plurality of lengths of tape applied to a sheet of glass.

FIG. 12*a* illustrates one preferred arrangement 300 of a plurality of lengths of tape applied to a sheet of glass 2, which gives the sheet of glass a simulated "classic" style of etching. The optical film in the tape 92 appears to have multiple bevels, to give a "V-groove" appearance. A suitable tape for this embodiment is commercially available as 3M™ Accentrim™ Tape, series B200 (V-groove), from 3M Company, located in St. Paul, Minn. As explained above, the actuators 30, 32, 34, 36 move the tape head 100 relative to the sheet of glass 2 to apply several lengths of tape 92. This arrangement 300 includes seven separate lengths of tape. The lengths of tape may be applied by the tape head 100 in any particular order. However, one preferred order is the following: a) applying the first length of tape 230; b) applying the second length of tape 232; c) applying the third length of tape 234; d) applying the fourth length of tape 236; e) applying the fifth length of tape 238; f) applying the sixth length of tape 240; and g) applying the seventh length of tape 242. Each length of tape has a first end 204 and a second end 205 opposite the first end 204. The ends 204, 205 of the lengths of tape 230, 232, 234, 236, 238, 240, 242 are cut by a desired blade configuration in the cutter 122, as explained above. For example, the second end 205 of the first length of tape 230 and the first end 204 of the second length of tape 232 was cut by the second blade configuration 124*b* of the cutter 122 illustrated in FIG. 4*b* to provide angled ends 204, 205. The removable portions of tape between the first length of tape 230 and the second length of tape 232 was similar to the removable portion of tape illustrated in FIG. 5*a*. As another example, the second end 205 of the third length of tape 234 was cut by the third blade configuration 124*c* of the cutter 122 illustrated in FIG. 4*c* to form a straight end having a 90° angle, cut relative to the length of the tape. However, the second end 205 of the third length of tape 234 may also have been cut obliquely to the length of the tape by the cutter 122 to have angled ends similar to the angled ends 204, 205 of the second length of tape 232. The ends 204, 205 of the lengths of tape 230, 232, 234, 236, 240, 242 form intersections 220.

Figure 12B:
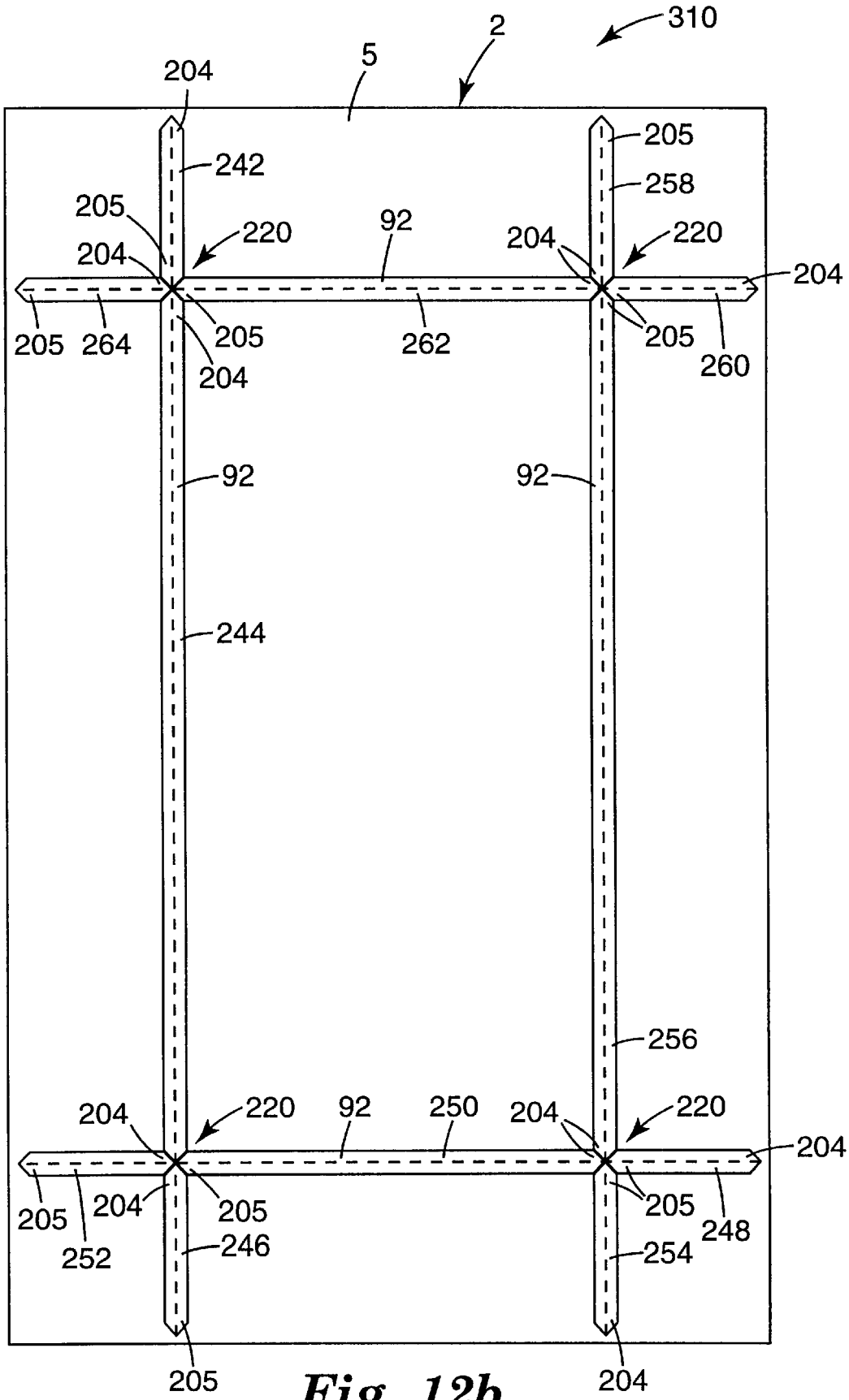
FIG. 12*b* illustrates another preferred arrangement of a plurality of lengths of tape applied to a sheet of glass.

FIG. 12*b* illustrates another arrangement 310 of a plurality of lengths of tape applied to a sheet of glass 2, which gives the sheet of glass a simulated "prairie" style of etching. The optical film in the tape 92 appears to have multiple bevels, to give a "V-groove" appearance. A suitable tape for this embodiment is commercially available as 3M™ Accentrim™ Tape, series B200 (V-groove), from 3M Company, located in St. Paul, Minn. As explained above, the actuators 30, 32, 34, 36 move the tape head 100 relative to the sheet of glass 2 to apply several lengths of tape 92. This arrangement 310 includes twelve separate lengths of tape. The lengths of tape may be applied by the tape head 100 in any particular order. However, one preferred order is the following: a) applying the first length of tape 242; b) applying the second length of tape 244; c) applying the third length of tape 246; d) applying the fourth length of tape 248; e) applying the fifth length of tape 250; f) applying the sixth length of tape 252; g) applying the seventh length of tape 254; h) applying the eighth length of tape 256; i) applying the ninth length of tape 258; j) applying the tenth length of tape 260; j) applying the eleventh length of tape 262; and k) applying the twelfth length of tape 264. The lengths of tape each include angled ends 204, 205 and form intersections 220. The second blade configuration 124*b* of the cutter 122 illustrated in FIG. 4*b* was used to provide angled ends 204, 205. The removable portions of tape were similar to the removable portion of tape illustrated in FIG. 5*a*.

Figure 12C:
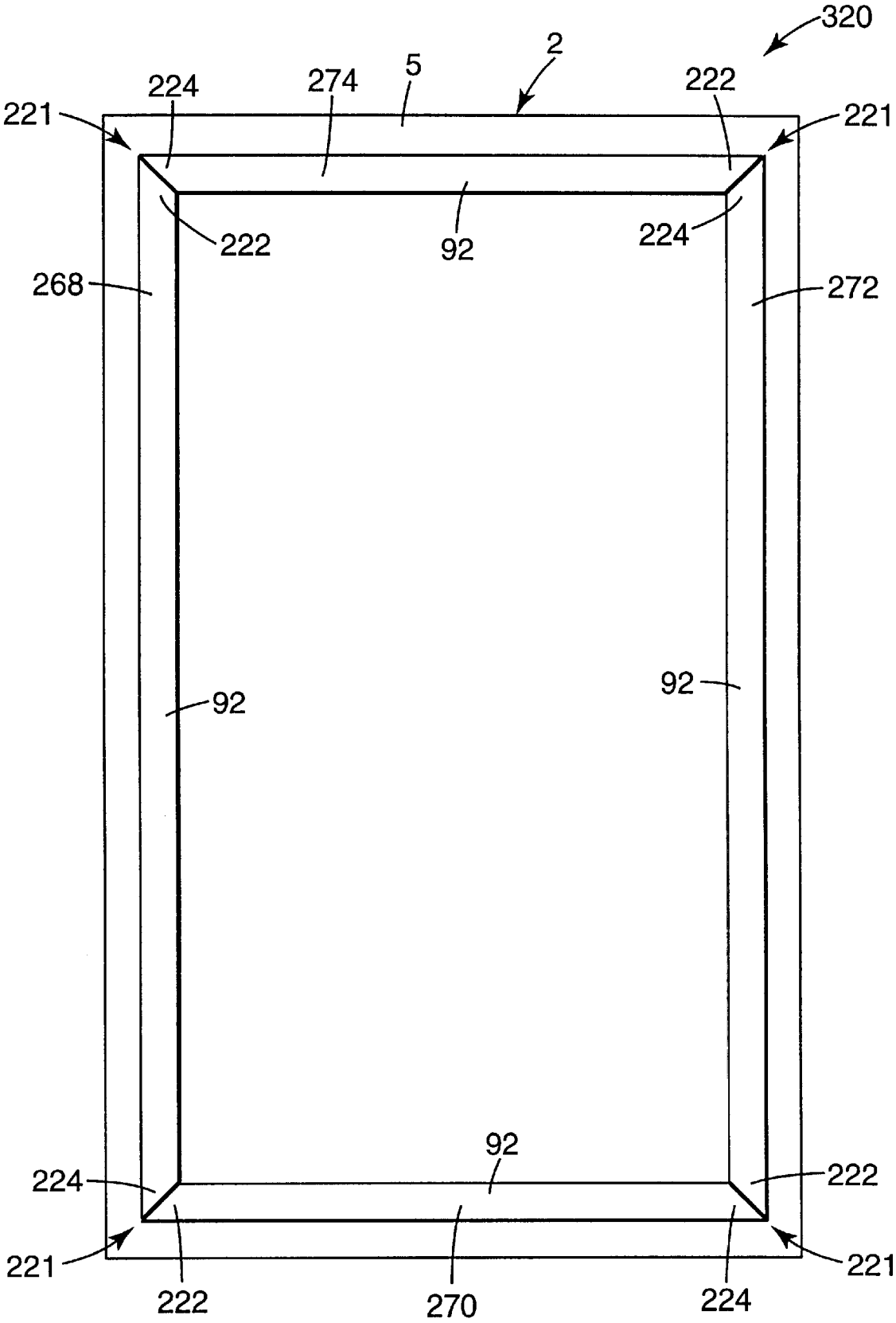
FIG. 12*c* illustrates yet another preferred arrangement of a plurality of lengths of tape applied to a sheet of glass.

FIG. 12*c* illustrates yet another arrangement 320 of a plurality of lengths of tape applied to a sheet of glass 2, which gives the sheet of glass a simulated "framed" style of etching. The optical film in the tape 92 has a single bevel appearance. A suitable tape for this embodiment is commercially available as 3M™ Accentrim™ Tape, series B100 (edge bevel), from 3M Company, located in St. Paul, Minn. As explained above, the actuators 30, 32, 34, 36 move the tape head 100 relative to the sheet of glass 2 to apply several lengths of tape 92. This arrangement 320 includes four separate lengths of tape. The lengths of tape may be applied by the tape head 100 in any particular order. However, one preferred order is the following: a) applying the first length of tape 268; b) applying the second length of tape 270; c) applying the third length of tape 272; d) applying the fourth length of tape 274. The lengths of tape each include angled ends 222, 224 and form intersections 221. The removable portions of tape were similar to the removable portion of tape illustrated in FIG. 5*b*.

FIGS. 12*a*–12*c* illustrate just a few preferred embodiments of tape applied to a sheet of glass. However, the tape applicator may create any layout of tape on a surface because of the flexibility of the tape head 100 and actuators 30, 32, 34, 36 to move the tape head 100 at any angle along the tabletop 22 and to apply tape at any angle along the tabletop. The tape head 100 also has flexibility to form a variety of shaped or angled ends 204, 205 in the lengths of tape because the tape head 100 could use any blade configuration to cut any shape in the tape to form a variety of shaped removable portion of tape 98.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A tape head, comprising:

i) a base;

ii) a tape roll holder attached to said base;

iii) a tape application roller attached to said base for applying the tape to a surface, wherein said tape head includes a tape path from said tape roll holder to said tape application roller;

iv) a cutter attached to said base along said tape path between said tape roll holder and said tape applicator miter for cutting tape to form a removeable portion of a tape; and v) a remover attached to said base along said tape path between said cutter and said tape application roller for removing the removeable portion of the tape, wherein said remover includes a pad, wherein said pad includes an exposed face facing said tape path, and wherein said pad is configured to contact the removeable portion of the tape.

2. The tape head of claim 1, wherein said cutter comprises a rotary die.

3. The tape head of claim 2, wherein said rotary die is configured to cut one of a plurality of shapes.

4. The tape head of claim 1, wherein said tape head further comprises a first actuator for moving said remover from a first position adjacent said tape path to a second position remote said tape path.

5. The tape head of claim 4, wherein said tape head further comprises a second actuator for moving said tape application roller from a first position remote said tape path to a second position adjacent said tape path.

6. The tape head of claim 1, wherein said pad moves to a first position adjacent the removeable portion of the tape to a second position remote said tape path, said first position of said pad adjusts to accommodate the accumulated thickness of the increasing number of removed portions of tape.

7. The tape head of claim 6, wherein said remover further includes a channel, wherein said pad is slideably engaged with said channel, wherein as said pad accumulates increasing number of the removable portions of the tape, said pad moves to successive first positions within said channel to accommodate the accumulated thickness of the increasing number of removed portions of tape.

8. The tape head of claim 7, wherein said pad further includes an adhesive layer on said exposed face of said pad, wherein when said pad is in the first position, said adhesive layer adheres to a first removeable portion of tape.

9. The tape head of claim 8, wherein said tape includes a tape backing and a layer of adhesive on said backing, wherein said tape is on a liner, wherein after said remover moves to said second position, said remover moves to said first position and said layer of adhesive on said first removeable portion of tape adheres to a second removeable portion of tape.

10. The tape head of claim 1, wherein said tape head further comprises a unwind roller attached to said base along said tape path between said tape roll holder and said tape application roller.

11. The tape head of claim 10, wherein said tape head further comprises a motor for driving said unwind roller at a speed greater than or equal to the speed said tape head is applying tape to a surface.

12. The tape head of claim 1, wherein said tape head further comprises a platen attached to said base along said tape path between said remover and said tape application roller, wherein said platen includes an edge, wherein said tape head further comprises a liner roller attached to said base, wherein said tape head includes a liner tape path from said edge to said liner roller.

13. The tape head of claim 12, wherein said liner roller is a driven liner roller.

14. A tape applicator including the tape head of claim 1, further comprising:

an x-axis actuator operatively connected to said tape head for moving said tape head in the x-axis direction; and a y-axis actuator operatively connected to said tape head for moving said tape head in the y-axis direction.

15. The tape applicator of claim 14, further comprising:

a rotary actuator operatively connected to said tape head for rotating said tape head around the z-axis direction.

16. A tape applicator including the tape head of claim 1, further comprising:

a frame having a tabletop, wherein said tabletop includes an x-axis and a y-axis;

a first sliding rod attached to said tabletop, wherein said first sliding rod extends in the x-axis direction; and a support arm for said tape head, wherein said support arm is moveably engaged to said first sliding rod, wherein said support arm extends in the y-axis direction, wherein said support arm includes second sliding rod extending in the y-axis direction, wherein said tape head is moveably engaged to said second sliding rod.

17. The tape applicator of claim 16, further comprising:

a x-axis actuator operatively connected to said tape head for moving said support arm in the x-axis direction along said first sliding rod;

a y-axis actuator operatively connected to said tape head for moving said tape head in the y-axis direction along said second sliding rod;

a rotary actuator operatively connected to said tape head for rotating said tape head around the z-axis direction; and a z-axis actuator operatively connected to said tape head for moving said tape head in the z-axis direction along a third sliding rod, wherein said third sliding rod is attached to said support arm, and wherein said third sliding rod extends in the z-axis direction.

* * * * *

UNITED STATES PATENT AND TRADEMARK OFFICE

CERTIFICATE OF CORRECTION

PATENT NO. : 6,634,401 B2
DATED : October 21, 2003
INVENTOR(S) : Kuhn, Gary K.

It is certified that error appears in the above-identified patent and that said Letters Patent is hereby corrected as shown below:

Column 2,
Line 34, delete “comprises:i)” and insert -- comprises: i) -- therefor.

Column 3,
Line 39, delete “describe” and insert -- described -- therefor.

Column 9,
Line 41, delete “146” and insert -- 156 -- therefor.

Column 12,
Line 1, after “portion” insert -- of --.
Line 15, after “against” insert -- the --.

Column 13,
Line 5, delete “156” and insert -- 154 -- therefor.

Column 14,
Line 14, after “6K8” delete “)”.

Column 15,
Line 17, delete “j)” and insert -- k) -- , delete “k)” and insert -- I) -- therefor.
Line 49, delete “22” and insert -- 2 -- therefor.
Line 54, delete “portion” and insert -- portions -- therefor.

UNITED STATES PATENT AND TRADEMARK OFFICE

CERTIFICATE OF CORRECTION

PATENT NO. : 6,634,401 B2
DATED : October 21, 2003
INVENTOR(S) : Kuhn, Gary K.

It is certified that error appears in the above-identified patent and that said Letters Patent is hereby corrected as shown below:

Column 16,
Line 11, delete “miter” and insert -- roller -- therefor.

Signed and Sealed this

Twenty-first Day of June, 2005

JON W. DUDAS
*Director of the United States Patent and Trademark Office*